US005155015A

United States Patent [19]

Jimbo

[11] Patent Number: 5,155,015

[45] Date of Patent: Oct. 13, 1992

[54] SILVER HALIDE PHOTOGRAPHIC MATERIAL

[75] Inventor: Yoshihiro Jimbo, Kanagawa, Japan

[73] Assignee: Fuji Photo Film Co., Ltd., Kanagawa, Japan

[21] Appl. No.: 858,598

[22] Filed: Mar. 27, 1992

[30] Foreign Application Priority Data

Mar. 27, 1991 [JP] Japan ..... 3-85744

[51] Int. Cl.[5] ..... G03C 1/06

[52] U.S. Cl. ..... 430/517; 430/510; 548/228; 549/321

[58] Field of Search ..... 430/510, 517, 591; 548/228; 549/321

[56] References Cited

U.S. PATENT DOCUMENTS 4,446,222 5/1984 Long ..... 430/517

5,075,205 12/1991 Inagaki et al. ..... 430/517

*Primary Examiner*—Jack P. Brammer

*Attorney, Agent, or Firm*—Sughrue, Mion, Zinn, Macpeak & Seas

[57] ABSTRACT

A silver halide photographic material contains in a hydrophilic colloid layer a 4-arylazooxazoline-5-one compound or/and a 2-arylazo-3-butene-4-olide compound in the form of a dispersion of fine solid particles or a composition with an oil or/and a polymer latex. The compounds not only can selectively color a particular layer alone but also can be speedily decolorized and/or eluted in the course of development processing. In addition, they have no undesirable effects on photographic characteristics.

6 Claims, No Drawings

SILVER HALIDE PHOTOGRAPHIC MATERIAL

FIELD OF THE INVENTION

This invention relates to a silver halide photographic material which has a colored layer and, more particularly, to a silver halide photographic material provided with a hydrophilic colloid layer containing a dye which is not only easily decolorized and/or eluted by a photographic processing but also photochemically inert.

BACKGROUND OF THE INVENTION

For the purpose of causing silver halide photographic materials to absorb light at particular wavelengths, the photographic emulsion or the other hydrophilic colloid layers of such materials are often colored.

When it becomes necessary to control the spectral composition of light incident upon a photographic emulsion layer, the photographic emulsion layer is generally provided with a colored layer on the side farther from the support. Such a colored layer is called a filter layer. In cases where a plurality of photographic emulsion layers are present, any two of them may have a filter layer between them.

It is desirable to prevent images from being blurred (that is to say, to prevent halation from occurring), which is due to (i) scattering of light upon passage through photographic emulsion layers or after transmission thereby, (ii) reflection of the scattered light at the interface of the emulsion layer and the support or by the surface of the photographic material situated in the position opposite to the emulsion layer side, and (iii) re-incidence of the reflected light on the photographic emulsion layer. To do this, a colored layer called an anti-halation layer is formed between the photographic emulsion layer and the support, or on the back side of the support (which is opposite to the emulsion layer side). In cases where a plurality of photographic emulsion layers are present, an antihalation layer may be sandwiched between any two of them. In order to prevent image sharpness from lowering because of the scattering of light inside the photographic emulsion layers (this phenomenon is generally called irradiation), one can also color the photographic emulsion layers.

Usually dyes are incorporated into the hydrophilic colloid layers to be colored. It is required that such dyes satisfy the following requirements:

(1) their spectral absorption is proper for the end-use purpose;

(2) they are inert photochemically. That is, they do not have in a chemical sense any bad influence on the properties of the silver halide emulsion layers, such as lowering sensitivity, fading latent images, generation of fog, and so on;

(3) they are decolorized in the course of photographic processing, or eluted by a processing solution or washing water to leave no harmful influence on the photographic material after.the processing;

(4) they do not diffuse from the colored layer into other layers; and (5) they have excellent storage stability in the form of solution or when they are incorporated into a photographic material, so that they cause neither color change nor fading upon storage.

In special cases where the colored layer is a filter layer or an antihalation layer disposed on the photographic emulsion layer side of a support, it is often necessary for these layers to be colored selectively and to be designed so that the coloring may not reach in a substantial sense into other layers. This is because the spread of coloring not only exerts a harmful influence on the spectral characteristics of the other layers but also spoils the function of the filter or antihalation layer. However, it frequently occurs that when the layer to which a dye is added and another hydrophilic colloid layer are brought into contact with each other in a wet condition, part of the dye diffuses from the former layer into the latter one. Many efforts, therefore, have been made to prevent such diffusion of the dye.

For instance, U.S. Pat. Nos. 2,548,564, 4,124,386 and 3,625,694 disclose a method in which a hydrophilic polymer bearing a positive charge is incorporated as a mordant into the layer containing a dissociated anionic dye to localize the dye to that layer through electrostatic interaction with the dye molecule.

In addition, a method of dyeing a particular layer with water-insoluble solid particles of a dye is disclosed in JP-A-56-12639 (the term "JP-A" as used herein means an "unexamined published Japanese patent application"), JP-A-55-155350, JP-A-55-155351, JP-A-63-27838, JP-A-63-197943, European Patents 15,601, 274,723, 276,566 and 299,435, U.S. Pat. No. 4,803,150, WO 88/04794, and so on.

Moreover, a method of dyeing a particular layer with dye-adsorbed fine particles of a metal salt is disclosed in U.S. Pat. Nos. 2,719,088, 2,496,841 and 2,496,843, JP-A-60-45337, and so on.

However, when such improved methods are used, the speed of decolorization and/or elution of the dyes at the time of development is low, so that it is difficult to get rid of color stain arising from the dyes in cases where processing speed is increased, compositions of the processing solutions and those of the photographic emulsions are modified, and other factors are changed.

SUMMARY OF THE INVENTION

Therefore, an object of this invention is to provide a photographic material containing a dye, which not only can selectively color a particular layer alone but also can be speedily decolorized and/or eluted in the course of development processing, in the form of dispersion of solid fine particles or as a composition with an oil or a polymer latex.

As a result of intensive examination, it has been found that this and other objects of this invention can be attained with a silver halide photographic material which contains at least one compound represented by the following general formula (I):

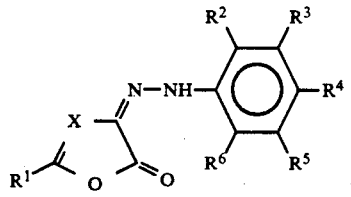

(I)

wherein X represents a nitrogen atom or a methine group; $R^1$ represents a hydrogen atom, an alkyl group, an aryl group, or a heterocyclyl group; $R^2$, $R^3$, $R^4$, $R^5$ and $R^6$ each represents a hydrogen atom, a halogen atom, an alkyl group, an aryl group, $—OR^7$, $—COOR^7$, $—COR^7$, $—CONR^7R^8$, $—SO_2NR^7R^8$, $—NR^7R^8$, $—SO_2NHCOR^7$, $—SO_2NHSO_2R^7$, $—CONHCOR^7$, —$CONHSO_2R^7$, —$N(R^7)SO_2R^8$, or —$N(R^7)COR^8$; and $R^7$ and $R^8$ each represents a hydrogen atom, an alkyl group, an aryl group, or a heterocyclyl group.

DETAILED DESCRIPTION OF THE INVENTION

When the dyes of this invention are used in the form of a dispersion of solid fine particles, it is desirable that sulfonic acid, sulfonate and carboxylate groups should not be contained therein as substituent groups.

When the dyes of this invention are used in a composition with an oil and/or a polymer latex, it is to be desired that in addition to containing no sulfonic acid group, sulfonate group or carboxylate group, they should also have a high solubility in an organic solvent having a boiling point of from about 30° C. to about 150° C., e.g., a lower alkyl acetate such as ethyl acetate or butyl acetate, ethyl propionate, secondary butyl alcohol, methyl isobutyl ketone, β-ethoxyethyl acetate, methyl cellosolve acetate and so on, or in a solvent highly soluble in water, e.g., an alcohol such as methanol, ethanol or the like.

In dyes of general formula (I), X represents a nitrogen atom or a methine group, preferably a nitrogen atom or —CH=. An alkyl group represented by $R^1$ is preferably one which contains 1 to 7 carbon atoms, such as methyl, ethyl, propyl, butyl, cyclohexyl or so on. These groups may have a substituent group, such as a halogen atom (for instance, chlorine), an ester group (for instance, ethoxycarbonyl and acetoxy), a carboxyl group, a sulfonamido group (for instance, methanesulfonamido and benzenesulfonamido), a sulfamoyl group, an acetylaminosulfonyl group, a phenoxy group (for instance, benzenesulfonamidophenoxy and methanesulfonamidophenoxy), or so on. An aryl group represented by $R^1$ is preferably one which contains 6 to 10 carbon atoms, such as phenyl or naphthyl. These groups may have a substituent group, such as a halogen atom (for instance, chlorine), an ester group (for instance, ethoxycarbonyl and acetoxy), a carboxyl group, a sulfonamido group (for instance, methanesulfonamido, ethanesulfonamido and benzenesulfonamido), a sulfamoyl group, an acetylaminosulfonyl group, a methylsulfonylaminosulfonyl group, a methylsulfonylaminocarbonyl group, a hydroxyl group, a dialkylamino group, or an alkyl group. A heterocyclyl group represented by $R^1$ is preferably a furyl group, a thiophenyl group, a sulfolanyl group, a pyrrolyl group or so on. These groups may have a substituent group, such as an ester group (for instance, ethoxycarbonyl and methoxycarbonyl), a sulfonamido group (for instance, ethanesulfonamido, benzenesulfonamido and paranitrobenzenesulfonamido), an alkyl group which contains 1 to 4 carbon atoms (for instance, methyl) or so on.

A halogen atom represented by $R^2$, $R^3$, $R^4$, $R^5$ and $R^6$ is preferably a chlorine atom.

An alkyl group represented by $R^2$, $R^3$, $R^4$, $R^5$ and $R^6$ is preferably one which contains 1 to 6 carbon atoms, particularly preferably a methyl or ethyl group.

An aryl group represented by $R^2$, $R^3$, $R^4$, $R^5$ and $R^6$ is preferably one which contains 6 to 10 carbon atoms, particularly preferably phenyl, p-tolyl, p-methoxyphenyl or the like.

An alkyl group represented by $R^7$ and $R^8$ is preferably one which contains 1 to 12 carbon atoms, with suitable examples including unsubstituted alkyl groups (e.g., methyl, ethyl, propyl) and substituted ones (e.g., alkyl groups containing an ester group, such as ethoxycarbonylmethyl, 2-ethylhexyloxycarbonylethyl, etc., alkyl groups containing an amido group, such as N-propylcarbamoylmethyl, acetamidoethyl, etc., alkyl groups containing halogen. atoms, such as trifluoromethyl, 2,2,2-trichloroethyl, etc., alkyl groups containing a hydroxyl group, such as 2-hydroxyethyl, etc., alkyl groups containing a sulfonamido group, such as 2-methanesulfonamidoethyl, 3-sulfamoylpropyl, etc., alkyl groups containing a carboxyl group, such as carboxymethyl, 2-carboxyl-2-propyl, etc., and so on).

An aryl group represented by $R^7$ and $R^8$ is preferably one which contains 6 to 10 carbon atoms, with suitable examples including unsubstituted aryl groups (e.g., phenyl) and substituted ones (e.g., aryl groups containing a hydroxyl group, such as 4-hydroxyphenyl, etc., aryl groups containing a nitro group, such as 4-nitrophenyl, etc., aryl groups containing an amino group, such as dimethylaminophenyl, etc., aryl groups containing a carboxyl group, such as 2-carboxyphenyl, 2-methoxy-5-carboxyphenyl, etc., and so on).

A heterocyclyl group represented by $R^7$ and $R^8$ is preferably furyl, pyridyl or the like.

Specific examples of the compound represented by general formula (I) are illustrated below. However, this invention should not be construed as being limited to these examples.

1.

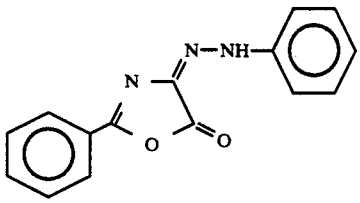

2.

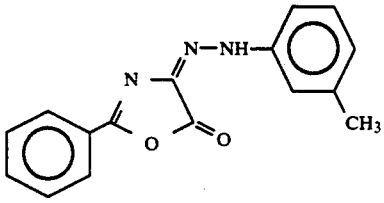

-continued
3.
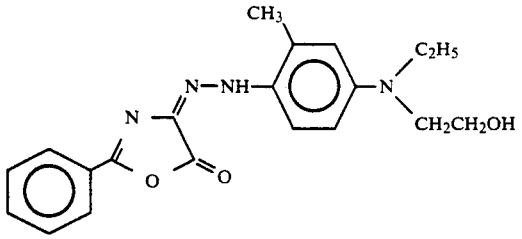
4.
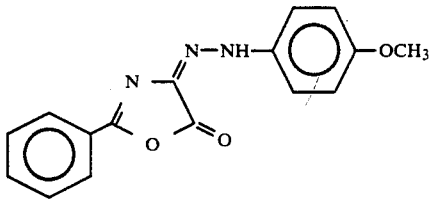
5.
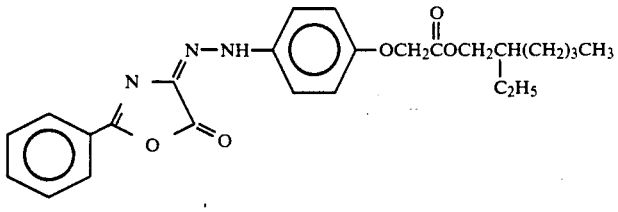
6.
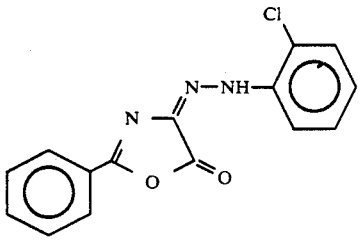
7.
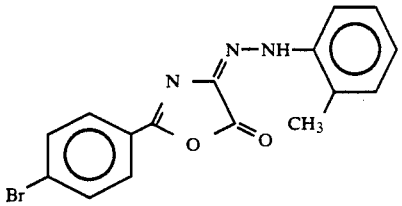
8.
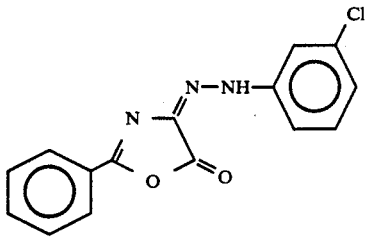
9.
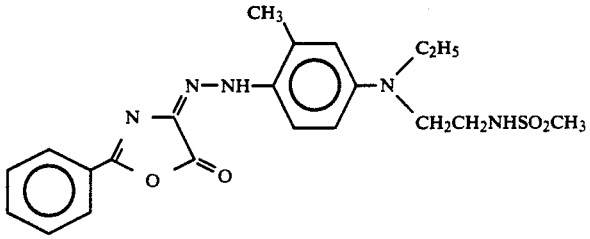

-continued
10.
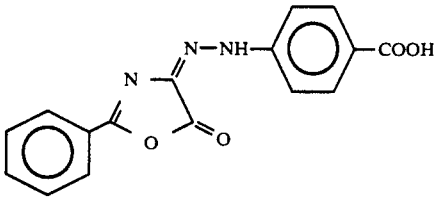
11.
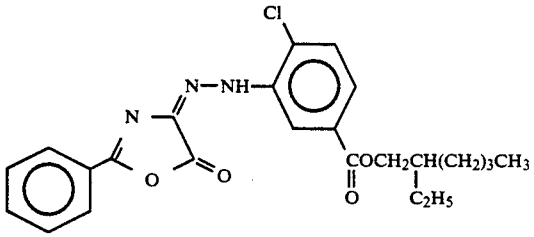
12.
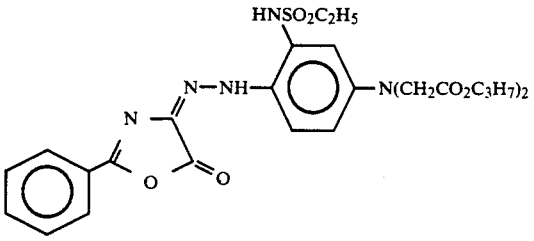
13.
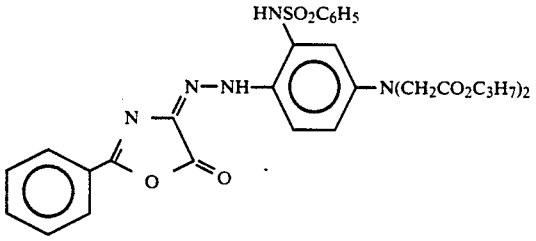
14.
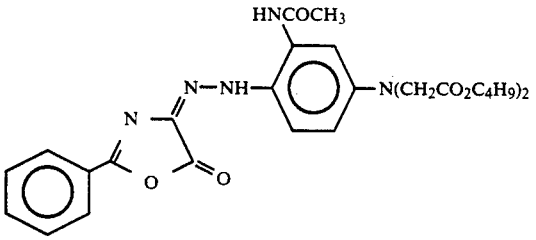
15.
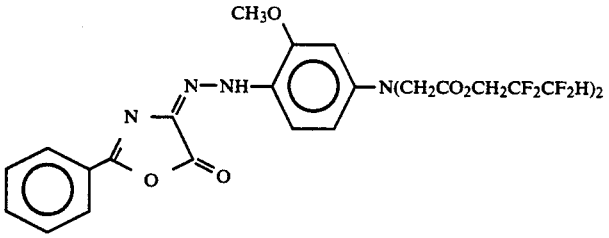
16.
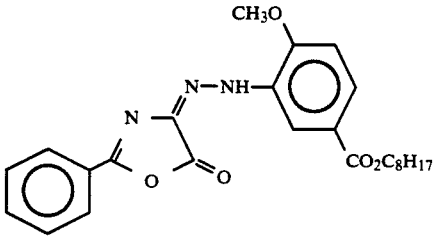

-continued
17.
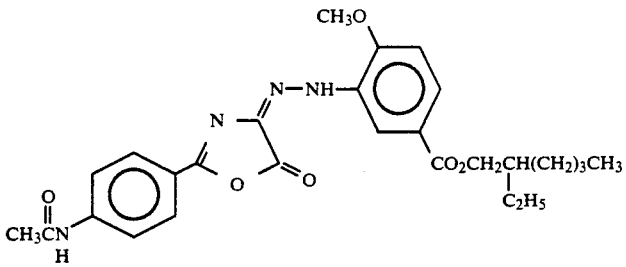
18.
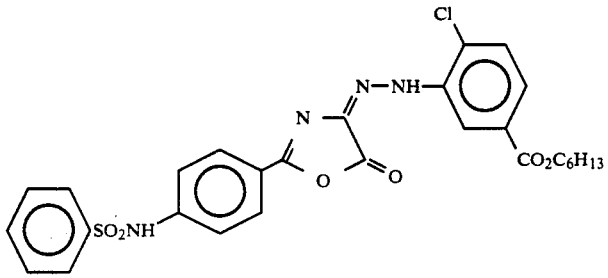
19.
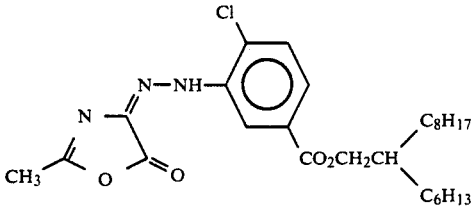
20.
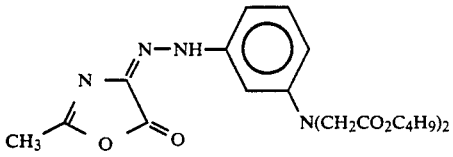
21.
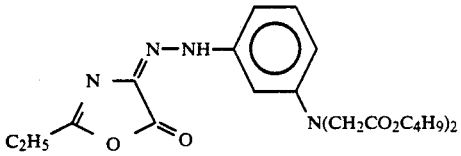
22.
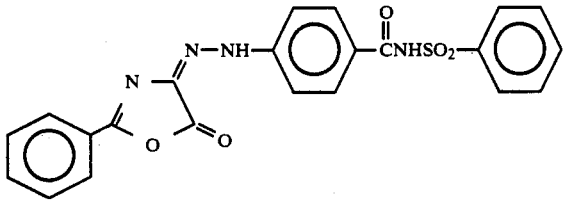
23.
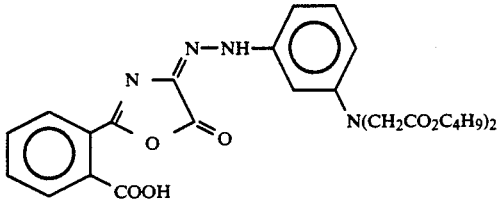

-continued
24.
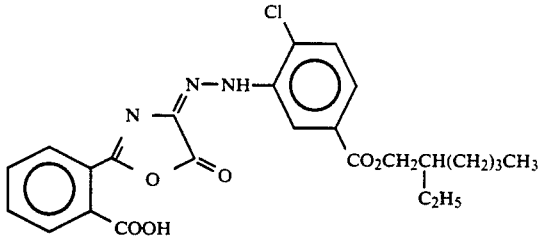
25.
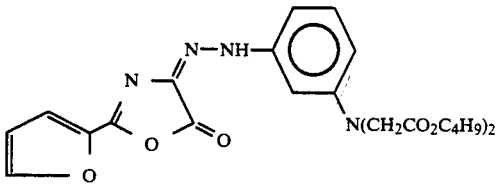
26.
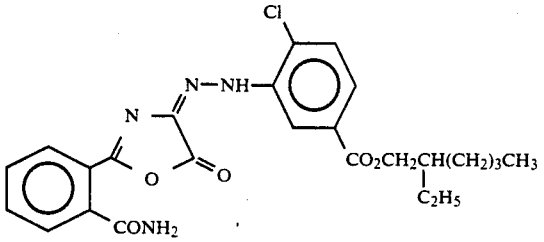
27.
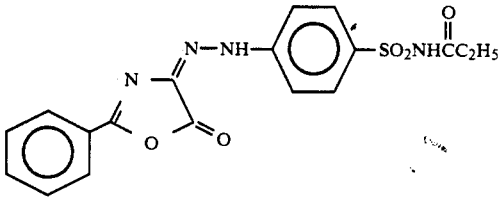
28.
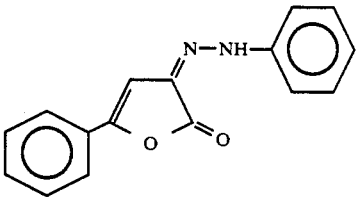
29.
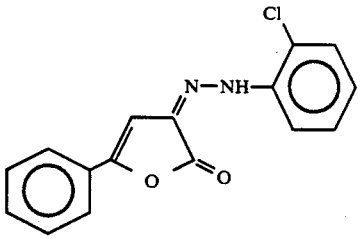
30.
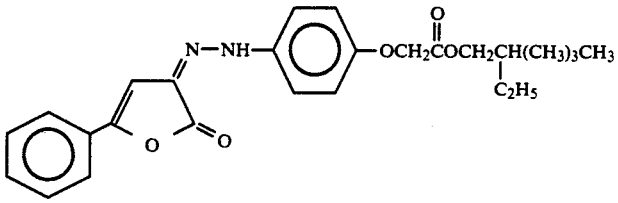

-continued

31.

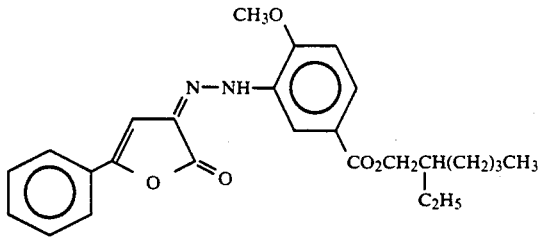

32.

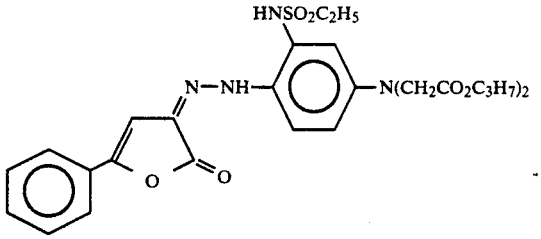

33.

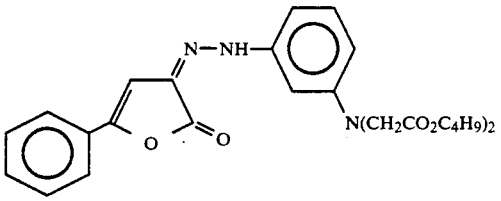

34.

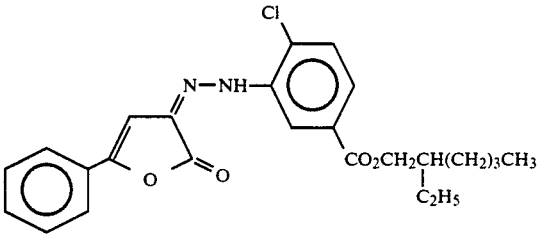

35.

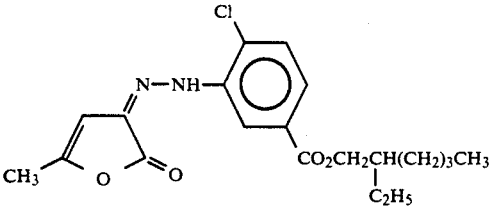

36.

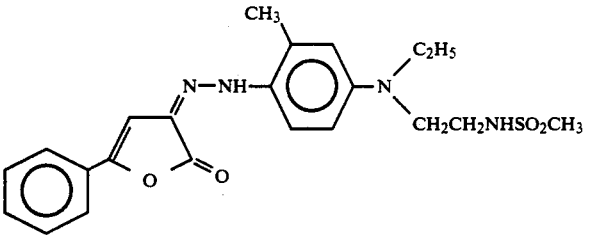

Compounds represented by general formula (I) can be synthesized using methods as described in *J. Chem. Eng.* Data, vol. 22, p. 104 (1977), *J. Am. Chem. Soc.*, vol. 79, p. 1955 (1957), *Can. J. Chem.*, vol. 41, p. 1813 (1963), and so on.

Synthesis examples thereof are described below.

Synthesis Example 1

Synthesis of Compound 1

A mixture of 4.5 g of hippuric acid and acetic anhydride was heated at 80° C. for 2 hours. The thus heated solution of the above-described oxazolone in acetic anhydride was added to a diazonium salt solution prepared from 1.9 g of aniline, 20 ml of acetic acid, 4 ml of concentrated hydrodhloric acid and 2.8 g of isoamyl nitrite and then mixed with 3.0 g of sodium acetate.

The resulting reaction mixture was stirred for 30 min. at room temperature and then cooled in an ice bath to precipitate crystals. These crystals were filtered off and recrystallized from 20 ml of acetone. Thus, 1.1 g of Compound 1 was obtained as yellow crystals.

$\lambda_{max}$ 418 nm, $\epsilon 3.26\times10^4$ (MeOH).

Synthesis Example 2

Synthesis of Compound 25

A solution of 12.5 g of benzoylpropionic acid in 50 ml of acetic anhydride was stirred at 100° C. for 1 hour. The solvent was distilled away under reduced pressure, and the residue was admixed with 15 ml of water and 45 ml of ethanol to undergo crystallization. The crystals were filtered off and dried to yield 7.2 g of γ-phenyl-ΔΔ, γ-butenolide.

A solution constituting 1.4 g of aniline, 3.8 ml of conc. hydrochloric acid and 15 ml of water was cooled in an ice bath. Thereto, a solution of 1.0 g of sodium nitrite in 5 ml of water was added, and stirred for 30 min., followed by addition of 4.5 g of sodium acetate. Further, a solution containing 1.4 g of γ-phenyl-Δβ, γ-butenolide in 10 ml of methanol was added and stirred for 10 minutes. The thus precipitated crystals were filtered off, washed with acetone, and then dried to yield 0.4 g of Compound 25 is yellow crystals.

$\lambda_{max}$ 425 nm, $\epsilon 4.07\times10^4$ (MeOH).

Synthesis Example 3

Synthesis of Compound 33

A diazonium salt solution was prepared by adding 0.78 g of sodium nitrite and 2.0 ml of water to a solution constituting 4.4 g (10 mmol) of 4-(N-ethyl-N β-methanesulfonamidoethyl)amino-2-methylaniline sulfate, 2.1 ml of conc. hydrochloric acid and 10 ml of water. To this diazonium salt solution, a solution constituting 1.6 g of γ-phenyl-Δβ, γ-butenolide, 4.5 g of triethylamine and 10 ml of methanol was added and stirred for 1 hour at room temperature.

The reaction product was extracted with ethyl acetate and dried with magnesium sulfate. Then, the solvent was distilled away under reduced pressure. The residue was purified by silica gel chromatography to yield 0.1 g of Compound 33 as orange crystals.

$\lambda_{max}$ 505 nm, $\epsilon 3.16\times10^4$ (Ethyl acetate).

The compound of general formula (I) is used in an amount of 1 to 1,000 mg, preferably 1 to 800 mg, per $m^2$ of the photographic material.

When the compound of general formula (I) is used as a filter dye or an antihalation dye, it can be used in any amount so long as it achieves its effect. However, it is desirable that the compound be used in such an amount as to control the optical density within the range of 0.05 to 3.5. The compound of this invention can be used in an emulsion layer or other hydrophilic colloid layers. The addition time thereof may be at any step in preparing such layers as long as it is before coating.

A fine grain dispersion of the compound of this invention can be formed using a method of precipitating the compound of this invention in the form of dispersion, and/or a method of finely dividing the compound of this invention in the presence of a dispersant by a known grinding means, e.g., ball milling (using a ball mill, a vibrating ball mill, a planet ball mill, etc.), sand milling, colloid milling, jet milling, roller milling or so on [optionally, in the presence of a solvent (e.g., water, an alcohol)]. In another method which can be used, the compound of this invention is dissolved in an appropriate solvent, and then a solvent in which the compound of this invention has poor solubility is added thereto to precipitate fine crystalline powder. Therein, a surface active agent for dispersion may be used together. In a further method, the compound of this invention is first dissolved by pH control, and then the pH of the solution is changed to cause fine crystallization. The fine crystalline grains of the compound of this invention in a dispersion have an average diameter of 10 μm or less, preferably 2 μm or less, particularly preferably 0.5 μm or less. In some cases, it is especially desired that the average diameter of the grains be 0.1 μm or less.

Dispersion of the dyes used in this invention into an oil and/or a polymer latex composition can be carried out using any of the following four methods:

1) The method comprises dissolving the compound in an oil, or a substantially water-insoluble solvent having a boiling point higher than about 160° C., and adding the resulting solution to a hydrophilic colloid solution, thereby achievihg the dispersion thereof. Specific examples of a high.boiling solvent which can be used therein include alkyl esters of phthalic acid (e.g., dibutyl phthalate, dioctyl phthalate), phosphoric acid esters (e.g., diphenyl phosphate, triphenyl phosphate, tricresyl phosphate, dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, diethyl azelate), trimesic acid esters (e.g., tributyl trimesate), and so on. Also, there can be used organic solvents having a boiling point within the range of about 30° C. to about 160° C., e.g., lower alkyl acetates such as ethyl acetate, butyl acetate, etc., ethyl propionate, secondary butyl alcohol, methyl isobutyl ketone, β-ethoxyethylacetate, methyl cellosolve acetate, and solvents highly miscible with water, e.g., alcohols such as methanol, ethanol and the like.

A ratio of the dye to the high boiling solvent ranges preferably from 10/1 to 1/10 (by weight).

2) The method comprises incorporating the dye of this invention and other additives into a photographic emulsion layer or another hydrophilic colloid layer in the form of packed polymer latex composition.

Specific examples df a polymer latex which can be used include polyurethane polymer and polymers prepared by the polymerization of vinyl monomer(s). Suitable examples of vinyl monomers include acrylic acid esters (e.g., methylacrylate, ethylacrylate, butylacrylate, hexylacrylate, octylacrylate, dodecylacrylate, glycidylacrylate), α-substituted acrylic acid esters (e.g., methylmethacrylate, butylmethacrylate, octylmethacrylate, glycidylmethacrylate), acrylamides (e.g., butylacrylamide, hexylacrylamide), β-substituted acrylamides (e.g., butylmethacrylamide, dibutylmethacrylamide), vinyl esters (e.g., vinyl acetate, vinyl butyrate), halogenated vinyl compounds (e.g., vinyl chloride), halogenated vinylidenes (e.g., vinylidene chloride), vinyl ethers (e.g., vinyl methyl ether, vinyl octyl ether), styrene, X-substituted styrenes (e.g. α-methylstyrene), nucleus-substituted styrenes (e.g., hydroxystyrene, chlorostyrene, methylstyrene), ethylene, propylene, butylene, butadiene, acrylonitrile and so on. These monomers may be polymerized independently, or in a combination of two or more. In the polymerization of these monomers, other vinyl monomers may be mixed as a minor constituent. Examples of vinyl monomers which can be used as minor constituent include itaconic acid, acrylic acid, methacrylic acid, hydroxyalkylacrylate, hydroxyalkylmethacrylate, .sulfoalkylacrylate, sulfoalkylmethacrylate, styrenesulfonic acid, etc.

These packed polymer latexes can be prepared according to the methods as disclosed in JP-B-51-39853 (the term "JP-B" as used herein means an "examined Japanese patent publication"), JP-A-51-59943, JP-A 53-137131, JP-A-54-32552, JP-A-54-107941, JP-A-55-133465, JP-A-56-19043, JP-A-56-19047, JP-A-56-126830 and JP-A-58-149038.

Herein, the ratio of the dye to the polymer latex ranges preferably from 10/1 to 1/10 (by weight).

3) The method comprises the same processes as the method 1), except that a hydrophilic polymer is used in the place of or in combination with the high boiling solvent. This method is described in U.S. Pat. No. 3,619,195 and West German Patent 1,957,467.

4) The method comprises dissolving the dye of this invention with the aid of a surface active agent.

The surface active agents useful in this method includes olygomers and polymers. The details of such polymers are described in JP-A-60-158437 (pages 19 to 27).

In addition, the hydrosol of a hydrophilic polymer as described, e.g., in JP-B-51-39835, may be added to the hydrophilic colloid dispersion obtained above.

As for the hydrophilic colloid, gelatin is typical, but any other hydrophilic colloid which is known to be suitable for photography ca be used.

The silver halide emulsion used in this invention is preferably one which comprises silver bromide, silver iodobromide, silver iodochlorobromide, silver chlorobromide or silver chloride.

Silver halide grains contained therein may have a regular crystal form, such as that of a cube, an octahedron, or so on; an irregular crystal form, such as that of a sphere, a tablet or so on; or a composite form thereof. Also, they may be a mixture of silver halide grains having various crystal forms. However, silver halide grains having a regular crystal form are preferred over the others.

The interior and the surface of the silver halide grains which can be used in this invention may differ or the silver halide grains may be uniform throughout. Further, either silver halide grains of the kind which form a latent image predominantly at the surface of the grains (e.g., negative emulsions), or grains of the kind which mainly form a latent image inside the grains (e.g., internal latent-image type emulsions, prefogged direct reversal emulsions) can be used. However, grains of the kind which form a latent image predominantly at the surface are preferred.

Silver halide emulsions favored in this invention are tabular-grain emulsions in which the proportion of tabular grains having a thickness of below 0.5 micron, preferably below 0.3 micron, a diameter of preferably at least 0.6 micron, and an average aspect ratio of at least 5, should be at least 50%, based on the projected area, to the whole grains present therein; or monodisperse emulsions which have a statistical variation coefficient (which is defined as the value obtained by dividing the standard deviation S by the diameter d, namely S/d, in the diameter distribution wherein the grain size refers to the diameter of the circle having the same area as the projected area of each grain) of 20% or less. Also, these tabular-grain or monodisperse emulsions may be used as a mixture of two or more thereof.

Photographic emulsions which can be used in this invention can be prepared using methods as described, for example, in P. Glafkides, *Chemie et Phisique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964); and so on.

Further, in order to control the grain growth at the time of forming silver halide grains, known silver halide solvents, e.g., ammonia, potassium thiocyanate, ammonium thiocyanate, thioether compounds as disclosed, e.g., in U.S. Pat. Nos. 3,271,157, 3,574,628, 3,704,130, 4,297,439 and 4276,374, thione compounds as disclosed, e.g., in JP-A-53-144319, JP-A-53-82408 and JP-A-55-77737, amine compounds as disclosed, e.g., in JP-A-54-100717, and so on, can be used.

Furthermore, in the course of forming silver halide grains or physically ripening them, cadmium salts, zinc salts, thallium salts, iridium salts or complex salts thereof, rhodium salts or complex salts thereof, iron salts or complex salts thereof, or the like can be present.

As for the binder or the protective colloid which can be used in the emulsion layers and the interlayers of the present photographic material, gelatin is used to advantage. Of course, other hydrophilic colloids can be also used. Specific examples of hydrophilic colloids which can be used include proteins such as gelatin derivative, graft copolymers prepared from gelatin and other high polymers, albumin, casein, etc.; sugar derivatives such as cellulose derivatives (e.g., hydroxyethyl cellulose, carboxymethyl cellulose, cellulose sulfate, etc.), sodium alginate, starch derivatives, etc.; and various kinds of synthetic hydrophilic macromolecular substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and the like.

The gelatins which can be used include not only lime-processed gelatin, but also acid-processed gelatin and enzyme-processed gelatin, as described, e.g., in *Bull. Soc. Sci. Photo. Japan*, No. 16, p. 30 (1966). In addition, hydrolysis products of gelatin can be used.

The photographic material of this invention may contain an inorganic or organic hardener in the photographic light-sensitive layers or any of the hydrophilic colloid layers constituting the backing layer. Specific examples of hardeners which can be used include chromium salts, aldehydes (e.g., formaldehyde, glyoxal, glutaraldehyde) and N-methylol compounds (e.g., dimethylol urea). In particular, active halogen-containing compounds (e.g., 2,4-dichloro-6-hydroxy -1,3,5-triazine and sodium salt thereof) and active vinyl-containing compounds (e.g., 1,3-bisvinylsulfonyl -2-propanol, 1,2-bis(vinylsulfonylacetamido)ethane, bis(vinylsulfonylmethyl)ether, vinyl polymers containing a vinylsulfonyl group in their side chains) are favored, because they can harden rapidly hydrophilic colloids such as gelatin and can stabilize photographic characteristics. In addition, N-carbamoylpyridinium salts (e.g., (1-morpholinocarbonyl-3-pyridinio) methanesulfonate) and haloamidinium salts (e.g., 1-(1-chloro-1-pyridinomethylene)pyrrolidinium-2-naphthalenesulfonate) are also excellent because of their rapid hardening speed.

The silver halide photographic emulsions used in this invention may be spectrally sensitized using methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. The nuclei usually present in cyanine dyes can be applied as the basic heterocyclic nuclei of these dyes. More specifically, basic heterocyclic nuclei include pyrroline, oxiazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these fused nuclei include indolenine, benzindolenine, indole, benzoxazole, naphthoxazole, benzothiazole, naphthothiazole, benzoselenazole, benzimidazole, quinoline and like nuclei. Each of these nuclei may have a substituent group on its carbon atom(s).

The merocyanine and complex merocyanine dyes can contain 5- or 6-membered heterocyclic nuclei such as pyrazoline-5-one, thiohydantoin, 2-thiooxazolidine -2,4-dione, thiazolidine-2,4-dione, rhodanine, thiobarbituric acid and like nuclei, as ketomethylene structure-containing nuclei.

These sensitizing dyes may be employed individually or in combination. In particular, combinations of sensitizing dyes are often employed for the purpose of supersensitization. On the other hand, substances which can exhibit a supersensitizing effect in combination with a certain sensitizing dye, although they themselves do not spectrally sensitize silver halide emulsions or do not absorb light in the visible region, may be incorporated into the silver halide emulsions. For instance, aminostilbene .compounds substituted by nitrogen-containing heterocyclic groups (as disclosed, e.g., in U.S. Pat. Nos. 2,933,390 and 3,635,721), aromatic organic acid-formaldehyde condensates (as disclosed, e.g., in U.S. Pat. No. 3,743,510), cadmium salts, azaindene compounds, and so on can be used. Particularly useful combinations are disclosed in U.S. Pat. Nos. 3,615,613, 3,615,641, 3,617,295 and 3,635,721.

The silver halide photographic emulsion of this invention can contain a wide variety of compounds for the purpose of preventing fog or stabilizing photographic functions during production, storage, or photographic processing. Specifically, a great number of compounds known as antifoggants or stabilizers, including azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and the like; mercaptopyrimidines; mercaptotriazines; thioketone compounds such as oxazolinethione; azaindenes such as triazaindenes, tetraazaindenes (especially 4-hydroxy substituted (1,3,3a,7) -tetraazaindene), pentaazaindenes and the like; benzenethiosulfonic acids; benzenesulfinic acid; benzenesulfonic acid amide; and so on can be added for the foregoing purpose.

The photographic material of this invention may contain one or more surface active agents for various purposes, such as for aiding coating, prevention of electrification, improvement of slipping properties, emulsification and dispersing, prevention of adhesion, and improvement of photographic characteristics (e.g., development acceleration, high contrast, and sensitization).

The photographic material produced in accordance with this invention may contain water-soluble dyes as a filter dye, an anti-irradiation dye or an anti-halation dye in hydrophilic colloid layers. Suitable examples of such dyes include oxonol dyes, hemioxonol dyes, styryl dyes, merocyanine dyes, anthraquinone dyes and azo dyes. In addition, cyanine dyes, azomethine dyes, triarylmethane dyes and phthalocyanine dyes are also useful. On the other hand, oil-soluble dyes can be added to hydrophilic colloid layers through emulsification using the oil-in-water dispersion method.

This invention can be applied to a multilayer multicolor photographic material having on a support at least two different spectral sensitivities. In general, the multilayer color photographic material comprises a support, at least one red-sensitive emulsion layer, at least one green-sensitive emulsion layer, and at least one blue-sensitive emulsion layer. These layers can be arranged in any order if desired. Preferable coating orders are a) support - red-sensitive layer - green-sensitive layer - blue-sensitive layer, b) support - blue-sensitive layer - green-sensitive layer - red- sensitive layer, and c) support - blue-sensitive layer - red-sensitive layer - green-sensitive layer. Moreover, any of the above-described emulsion layers may constitute at least two layers having the same color sensitivity but different photographic speeds with the intention of heightening achievable sensitivity, or may have three constituent layers to result in further improvement in graininess. In addition, a light-insensitive layer may be sandwiched between at least two emulsion layers having the same color sensitivity. Also, constituent layers having the same color sensitivity may have therebetween an emulsion layer differing therefrom in color sensitivity. Further, a reflecting layer comprising a fine-grain silver halide may be formed under a high speed emulsion layer, especially a high speed blue-sensitive emulsion layer.

In general, cyan fbrming couplers are incorporated into a red-sensitive emulsion layer, magenta forming couplers into a green-sensitive emulsion layer, and yellow forming layers into a blue-sensitive emulsion layer. As the case may be, any other combination may also be employed. For instance, an infrared sensitive layer may be incorporated for forming a pseudo-color photograph or for exposure to semiconductor lasers.

In the photographic material of this invention, the photographic emulsion layers and other layers are coated on a conventional flexible support such as a plastic film, paper, cloth or so on, or a conventional rigid support such as glass, earthenware, metal or so on. Suitable examples of a flexible support include films of a semisynthetic or synthetic high polymers, such as cellulose nitrate, cellulose acetate, cellulose acetate butyrate, polystyrene, polyvinyl chloride, polyethylene terephthalate, polycarbonate and so on, and paper coated or laminated by a baryta layer or an $\alpha$-olefin polymer (e.g., polyethylene, polypropylene, ethylene-butene copolymer). The support may be colored with a dye or a pigment. Also, it may be rendered black to screen the photographic material from light. The surface of these supports is generally provided with an undercoat in order to heighten the adhesiveness to the photographic emulsion layers and so on. Also, the support surface may undergo glow discharge, corona discharge, ultraviolet irradiation, flame or other treatments before or after formation of an undercoat.

The photographic emulsion layers and other hydrophilic colloid layers can be coated using various known coating methods, such as a dip coating method, a roller coating method, a curtain coating method, an extrusion coating method and so on. Many layers may be coated simultaneously using coating methods as described, e.g., in U.S. Pat. Nos. 2,681,294, 2,761,791, 3,526,528 and 3,508,947, if needed.

This invention can be applied to various color and black-and-white photographic materials. Representatives of such materials include color negative films for amateur or motion picture use, color reversal films for slide or television use, color papers, color positive films, color reversal papers, color diffusion transfer photosensitive materials and heat developable color photosensitive materials. In addition, this invention can be applied to X-ray black-and-white photographic materials by utilizing a three-color coupler mixture, as described, e.g., in *Research Disclosure*, No. 17123 (Jul., 1978), or by utilizing a black color-forming couple as disclosed, e.g., in U.S. Pat. No. 4,126,461 and British Patent 2,102,136. Further, the invention can also be applied to films for photomechanical process, such as a lith film, a scanner film, etc.; X-ray films for medical radiography and photofluorography, or for industrial use; photograph-taking negative black-and-white films; black-and-white photographic papers; microfilms for COM or general use; silver salt diffusion transfer photographic materials; and print-out photographic materials.

When applied to a color diffusion transfer photographic process, the photographic element according to this invention can have a film unit structure of the peel-apart type; integrated type as disclosed in JP-B-46-16356, JP-B-48-33697, JP-A-50-13040 and British Patent 1,330,524; or non peel-apart type as disclosed in JP-A-57-119345.

In every format described above, it is advantageous from the standpoint of broadening the latitude of processing temperature to provide a polymeric acid layer protected by a neutralization timing layer. When used in the color diffusion transfer process, the polymeric acid may be added to any of constituent layers of the photographic element or enclosed in a processing container as a developer component.

Various exposure means ca be applied to the photographic material of this invention. Any of the various light sources which can emit radiations corresponding to the wavelengths at which photographic materials have sensitivities can be used as those for irradiation or writing. Commonly used light sources include natural light (sun light), an incandescent lamp, a halogen-sealed lamp, a mercury lamp, a fluorescent lamp, and flash lamps such as Strobe, a metal combustion flash bulb and the like. In addition, gas, dye solution or semiconductor laser devices, light-emitting diodes and plasma light sources, which can emit light of wavelengths in the ultraviolet to infrared region, can be used as light sources for recording. Moreover, a fluorescent screen which can emit radiation upon excitement of phosphors with electron beams or the like (e.g., CRT), and an exposure means constructed by combining a microshutter array utilizing liquid crystals (LCD) or La-doped lead titanzirconate (PLZT) with linear or planar light sources can be used, too. Further, spectral distribution of exposure light can be controlled with color filters, if needed.

A color developer used for developing the photographic material of this invention is preferably an alkaline aqueous solution containing as a main component an aromatic primary amine type color developing agent. Those preferred as such a color developing agent are p-phenylenediamine compounds, though aminophenol compounds are also useful. Typical representatives of p-phenyliethylaniline, compounds include 3-methyl-4-amino -N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates of the above-cited anilines. Since these diamines are, in general, more stable in the form of a salt than in the free state, it is desirable to use these diamines in the form of salt. In general, the color developing solution contains pH buffering agents such as carbonates, borates or phosphates of alkali metals, and development inhibitors or antifoggants such as bromides, iodides, benzimidazoles, benzothiazoles or mercapto compounds. In addition, it can optionally contain various kinds of preservatives, e.g., hydroxylamines, dialkylhydroxylamines, hydrazines, triethanolamine, triethylenediamine, sulfites and so on; organic solvents such as triethanolamine, diethylene glycol, etc.; development accelerators such as benzyl alcohol, polyethylene glycol, quaternary ammonium salts, amines, etc.; dye forming couplers; competing couplers; fogging agents such as sodium boron hydride; auxiliary developing agents such as 1-phenyl-3-pyrazolidone, etc.; viscosity imparting agents; various chelating agents represented by aminopolycarboxylic acids, aminopolyphosphonic acids, alkylphosphonic acids and phosphonocarboxylic acids; antioxidants disclosed in West German Patent Application (OLS) No. 2,622,950; and so on.

In the color development of a reversal color photographic material, black-and-white development is generally performed prior to color development. In a black-and-white developing solution, known black-and-white developing agents, such as dihydroxybenzenes including hydroquinone, 3-pyrazolidones including 1-phenyl-3-pyrazolidone, or aminophenols including N-methyl-p-aminophenol, can be used individually or in combination.

To the photographic material of this invention, not only color development but also any other photographic development process can be applied. As for the developing agent used in the developer, there are those of dihydroxybenzene type, 1-phenyl-3-pyrazolidone type, p-aminophenol type, etc. These developing agents can be used alone or in combination (e.g., the combination of a 1-phenyl-3-pyrazolidone and a dihydroxybenzene, the combination of a p-aminophenol and a dihydroxybenzene). Also, the photographic material of this invention may be processed with a so-called infectious developer containing a sulfite ion buffer such as carbonyl bisulfite, etc., and hydroquinone.

As for the above-described developing agent of the dihydroxybenzene type, hydroquinone, chlorohydroquinone, bromohydroquinone, isopropylhydroquinone, toluhydrohydroquinone, methylhydroquinone, 2,3-dichlorohydroquinone, 2,5-dimethylhydroquinone and the like can be given as examples. As for the developing agent of the 1-phenyl-3-pyrazolidone type, 1-phenyl -3-pyrazolidone, 4,4-dimethyl-1-phenyl-3-pyrazolidone, 4-hydroxymethyl-4-methyl-1-phenyl-3-pyrazoldione, 4,4 -dihydroxymethyl-1-phenyl-3-pyrazolidone and the like can be given as examples. As for the developing agent of the p-aminophenol type, p-aminophenol, N-methyl-p-aminophenol and the like can be used.

To the developer, a compound capable of providing a free sulfite ion, such as sodium sulfite, potassium sulfite, potassium metabisulfite, sodium hydrogensulfite, etc., is added as preservative. In the case of an infectious developer, formaldehyde sodium bisulfite which provides little free sulfite ion in the developer may be used.

Examples of an alkali agent which can be used in the developer used in this invention include potassium hydroxide, sodium hydroxide; potassium carbonate, sodium carbonate, sodium acetate, potassium tertiary phosphate, diethanolamine, triethanolamine and so on. The developer is generally adjusted to pH 9 or higher, preferably pH 9.7 or higher.

The developer may contain organic compounds known as antifoggants or development inhibitors. Specific examples thereof include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and the like; mercaptopyrimidines; mercaptotriazines; thioketone compounds such as oxazolinethione; azaindenes such as triazaindenes, tetraazaindenes (especially 4-hydroxy substituted (1,3,3a,7)-tetraazaindene), pentaazaindenes and the like; benzenethiosulfonic acids; benzenesulfinic acid; benzenesulfonic acid amide; sodium 2-mercaptobenzimidazole-5-sulfonate; and so on.

The developer used in this invention may contain a polyalkylene oxide as a development inhibitor. For instance, polyethylene oxide having a molecular weight in the range of 1,000 to 10,000 can be added in an amount of 0.1 to 10 g/l.

To the developer suitable for this invention, a water softener such as nitrilotriacetic acid, ethylenediaminetetraacetic acid, triethylenetetraminehexaacetic acid, diethylenetetraminepentaacetic acid or so on is preferably added.

In the developer used in this invention, the compound disclosed in JP-A-56-24347 can be used as a silver stain inhibitor, the compound disclosed in JP-A-62-212651 as a development mark inhibitor, and the compound disclosed in Japanese Patent Application No. 60-109743 (corresponding to JP-A-61-267759) as a dissolution aid.

In the developer used in this invention, boric acid disclosed in JP-A-62-186259, the compounds disclosed in JP-A-60-93433 including sugars (e.g., saccharose), oximes (e.g., acetoxime), phenols (e.g., 5-sulfosalicylic acid), tertiary phosphates (e.g., sodium salt, potassium salt) and so on are used as buffers.

Various compounds may be used as a development accelerator in this invention. Such compounds may be added to the photographic material or to the processing solution. Suitable examples of a development accelerator which can be used include amine compounds, imidazole compounds, imidazoline compounds, phosphonium compounds, sulfonium compounds, hydrazine compounds, thioether compounds, thione compounds, certain mercapto compounds, meso ion compounds and thiocyanates. In particular, these development accelerators are required for rapid development to be performed in a short time. It is desirable to add these development accelerators to a color developer, but they can be incorporated in advance in the photographic emulsion depending on the kind of an accelerator to be used or the position at which a light-sensitive layer to be accelerated in developing speed is situated. Further, they can be added to both the developer and the photographic material. In some cases, a prebath is arranged prior to processing with a color developing bath, and such accelerators can be added in advance to the prebath.

Amine compounds useful as a development accelerator include both inorganic amines, such as hydroxylamine, and organic ones. Organic amines can be aliphatic, aromatic, cyclic, aliphatic-aromatic mixed, or heterocyclic amines. Additionally, primary, secondary and tertiary amines, and quaternary ammonium compounds are all effective.

Photographic emulsion layers are generally subjected to a bleach processing after the color development. The bleach processing may be carried out simultaneously with a fixation processing, or separately therefrom. In order to further increase processing speed, a bleach-fix processing may be carried out after a bleach processing. Examples of a bleaching agent which can be used include compounds of polyvalent metals, such as Fe(III), Co(III), Cr(IV), Cu(II) or the like; peroxy acids; quinones; nitron compounds; and so on. Representatives of such bleaching agents include ferricyanides; dichromates; Fe(III) or Co(III) complex salts of organic acids, for example, aminopolycarboxylic acids such as ethylenediaminetetraacetic acid, diethylenetriaminepentaacetic acid, nitrilotriacetic acid, 1,3-diamino-2-propanoltetraacetic acid, etc., citric acid, tartaric acid, malic acid, and so on; persulfates; permanganates; and nitrosophenol. Among these bleaching agents, ethylenediaminetetraacetato iron(III) complex salts, diethylenetriaminepentaacetato iron(III) complex salt and persulfates are particularly favored from the viewpoint of rapid processing and to prevent environmental pollution. Additionally, ethylenediaminetetraacetato iron(III) complex salts are especially useful in both an independent bleaching bath and a combined bleaching and fixing bath.

In a bleaching bath, a bleach-fix bath and/or a prebath thereof, a bleach accelerator can be used, if needed. Specific examples of useful bleach accelerators include mercapto group- or disulfide linkage-containing compounds as disclosed in U.S. Pat. No. 3,893,858, West German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, JP-A-53-28426, *Research Disclosure*, No. 17129 (Jul. 1978), and so on; thiazolidine derivatives disclosed in JP-A-50-140129; thiourea derivatives disclosed in JP-B-45-8506, JP-A-52-20832, JP-A-53-32735, and U.S. Pat. No. 3,706,561; iodides disclosed in West German Patent 1,127,715 and JP-A-58-16235; polyethylene oxides disclosed in West German Patents 966,410 and 2,748,430; polyamine compounds disclosed in JP-B-45-8836; the compounds disclosed in JP-A-49-42434, JP-A-49-59644, JP-A-53-94927, JP-A-54-35727, JP-A-55-26506 and JP-A-58-163940; and iodide and bromide ions. Among these compounds, those containing a mercapto group or a disulfide linkage are favored over others because of their great effect upon bleach acceleration. In particular, the compounds disclosed in U.S. Pat. No. 3,893,858, West German Patent 1,290,812 and JP-A-53-95630 are preferred. In addition, the compounds disclosed in U.S. Pat. No. 4,552,834 are desirable too. The bleach accelerators cited above may be incorporated into photosensitive materials. In the bleach-fix processing of color photosensitive materials for photograph-taking use, the bleach accelerators described above are especially effective.

Examples of suitable fixing agents include thiosulfates, thiocyanates, thioether compounds, thioureas, and a large quantity of iodide. However, thiosulfates are generally used as fixing agents. As preservatives of the bleach-fix bath and the fixing bath, sulfites, bisulfites or carbonyl-bisulfite adducts are preferably added.

After bleach-fix or fixation processing, washing and stabilization steps are generally taken. To a washing bath and a stabilizing bath used in these steps, various known additives may be added to prevent precipitation and save water. For instance, water softeners for prevention of precipitation, which include, e.g., inorganic phosphoric acids, aminopolycarboxylic acids, organic aminopolyphosphonic acids and organic phosphoric acids; bactericides and antimolds for preventing growth of various kinds of bacteria, weeds and molds; metallic salts represented by magnesium, aluminum and bismuth salts; surfactants for reduction of drying load and mark; various hardeners; and so on, can be added, if needed. Also, the compounds described, e.g., in L. E. West, *Phot. Sci. Eng.*, vol. 6, pp. 344–359 (1965) may be added. Among these additives, chelating agents and antimolds are effective in particular.

In the washing step, water is generally saved by adopting a multistage counter-current process in which at least two tanks are used and a current of water is made to flow in the counter direction. Instead of performing the washing step, a multistage counter-current stabilization process as disclosed in JP-A-57-8543 may be adopted. In this process, it is necessary to use a counter-current bath constructed with from 2 to 9 tanks. To the stabilizing bath, various kinds of additives for stabilization of images are added in addition to the above-cited ones. Typical examples of such additives include various buffers for adjustment of film pH (e.g., to 3 to 9), such as the combinations formed by properly choosing two or more from among borates, metaborates, borax, phosphates, carbonates, potassium hydroxide, sodium hydroxide, aqueous ammonia, monocarboxylic acids, dicarboxylic acids, polycarboxylic acids and so on, and aldehydes such as formaldehyde. Further, chelating agents (e.g., inorganic phosphoric acids, aminopolycarboxylic acids, organic phosphoric acids, organic phosphonic. acids, aminopolyphosphonic acids, phosphonocarboxylic acids), bactericides (e.g., benzoisothiazolinone, isothiazolone, 4-thiazolinebenzimidazole, halogenated phenols, sulfanylamides, benzotriazole), surfactants, brightening agents, hardeners and so on may be used as additives, if desired. Two or more of compounds having the same purpose or different purposes respectively may be added together.

Furthermore, various ammonium salts such as ammonium chloride, ammonium nitrate, ammonium sulfate, ammonium phosphate, ammonium sulfite, ammonium thiosulfate and the like are preferably added for pH adjustment of the processed films.

In the case of color photographic materials for photograph-taking, the washing-stabilization step usually taken after fixation can be replaced by the above-described stabilization and washing steps (water-economized step). Therein, formaldehyde can be removed from the stabilizing bath when the magenta couplers used are those of the two equivalent type.

The time required for the washing and stabilization step of this invention, though it depends on the kind of the photographic material to be processed and the processing condition, is generally within the range of 20 seconds to 10 minutes, preferably 20 seconds to 5 minutes.

In the silver halide color photographic material of this invention, a color developing agent may be incorporated with the intention of simplification and speedup of the photographic processing. In incorporating the color developing agent, it is to be desired that it be used in the form of a precursor, which can include various types. Examples of such precursors include indoaniline compounds disclosed in U.S. Pat. No. 3,342,597, compounds of the Schiff base type disclosed in U.S. Pat. No. 3,342,599, *Research Disclosure*, Nos. 14850 and 15159, aldol compounds disclosed in *Research Disclosure*, No. 13924, metal complexes disclosed in U.S. Pat. No. 3,719,492, urethane compounds disclosed in JP-A-53-135628, and various salt types as disclosed in JP-A-56-6235, JP-A-56-16133, JP-A-56-59232, JP A 56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531, JP-A-57-83565, and so on.

In the silver halide color photographic materials of this invention, various kinds of 1-phenyl -3-pyrazolidones may be incorporated for the purpose of acceleration of color development, if needed. Typical examples of such compounds are disclosed in JP-A-56-64339, JP-A-57-144547, JPA-57-211147, JP-A-58-50532, JP-A-58-50536, JP-A-58-50533, JP-A-58-50534, JP-A-58-50535, JP-A-58-115438, and so on.

Various kinds of processing solutions in this invention are used in the temperature range 10° C. to 50° C. Though the standard temperature is generally within the range of 33° C.. to 38° C., temperatures higher than the above range can be chosen with the intention of reducing the processing time through acceleration of the processing, or those lower than the foregoing range can be chosen in order to achieve an improvement in image quality and enhancement of the stability of the processing baths. In addition, a step utilizing cobalt intensification or hydrogen peroxide intensification as disclosed in West German Patent 2,226,770 or U.S. Pat. No. 3,674,499 may be taken for the purpose of economy of the silver to be contained in the photographic materials.

In every processing bath, a heater, a temperature sensor, a liquid level sensor, a circulation pump, a filter, a floating lid, a squeezer and so on may be installed, if needed.

When a photographic processing is carried out continuously, a change in composition of each processing solution is prevented by using a replenisher to ensure constant quality to the finished images. The amount of each replenisher used in .the present invention can be reduced to one-half or less its standard value for the purpose of cutting costs, and so on.

Adoption of a bleach-fix step is quite general when the photographic materials in accordance with the present invention are applied to color paper, while it is optional when they are applied to color photographic materials for photograph-taking use.

Now, the present invention is illustrated in more detail by reference to the following examples.

EXAMPLE 1

Preparation of Sample 1

1) Formation of Dye-Fixing Layer (Antihalation Layer)

Compound 2 exemplified as the dye compound of this invention was subjected to the ball mill processing disclosed in JP-A-63-197943.

More specifically, 434 ml of water and 791 ml of a 6.7% aqueous solution of surfactant, Triton X-200R, were placed in a 2-liter ball mill. Thereto were added 20 g of the dye compound and further 400 ml of zirconium oxide beads (diameter: 2 mm). The content was milled for 6 days. Thereafter, 160 g of a 12.5% aqueous solution of gelatin was added. After defoaming, the zirconium oxide beads were. removed by filtration. The obtained dye dispersion was observed to have a broad distribution of particle sizes. Diameters of the milled dye particles ranged from 0.04 to 1.05 μm.

A 100 μm-thick transparent PET film was used as the support. In order to heighten the adhesion between the support and a hydrophilic colloid layer, the support was subjected, in advance, to a corona discharge, and then coated with styrene-butadiene latex to form a first subbing layer. Further, gelatin was coated on the first subbing layer at a coverage of 0.08 g/m$^2$ to form a second subbing layer.

On the second subbing layer, the foregoing fine dispersion of dye was coated in the form of the gelatin dispersion described below to form an antihalation layer having the following coverages with respect to its constituents.

| | |
|---|---|
| Gelatin | 1.8 g/m$^2$ |
| Dye (Compound 2) | 140 mg/m$^2$ |
| Potassium polystyrenesulfonate (mean molecular weight: 600,000) | 35 mg/m$^2$ |
| 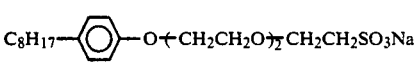 | 10 mg/m$^2$ |
| Phenoxyethanol | 18 mg/m$^2$ |
| 1,2-Bis(vinylsulfonylacetamido)ethane | 100 mg/m$^2$ |

2) Preparation of Emulsion to be coated

The primitive emulsion #1 described below is an emulsion of the kind which forms latent image predominantly at the surface of the grains, and exhibits the characteristics of a negative emulsion when universal processing solutions for commercially available microfilms are applied thereto. Further, it can provide characteristics of a positive emulsion when a reversal process using a reversing bath is applied thereto.

| <Preparation of Primitive Emulsion #1> | |
|---|---|
| Solution I (75° C.) | |
| Inert gelatin | 24 g |
| Distilled water | 900 ml |
| KBr | 4 g |
| 10% Aqueous solution of phosphoric acid | 2 ml |
| Sodium benzenesulfinate | $5 \times 10^{-2}$ mole |
| 1,2-Bis(2-hydroxyethylthio) ethane | $2.5 \times 10^{-2}$ mole |
| Solution II (35° C.) | |
| Silver nitrte | 170 g |
| Distilled water to make | 1,000 ml |
| Solution III (35° C.) | |

-continued

| <Preparation of Primitive Emulsion #1> | |
|---|---|
| KBr | 230 g |
| Distilled water to make | 1,000 ml |
| Solution IV (room temperature) | |
| Potassium hexacyanoferrate (II) | 3.0 g |
| Distilled water to make | 100 ml |

To the thoroughly stirred Solution I, Solution II and Solution III were simultaneously added over a 45-minute period. At the conclusion of the addition of the whole amount of Solution II, a monodisperse emulsion comprising cubic silver bromide grains finally having an average grain size of 0.28 μm was obtained.

The addition speed of Solution III was determined depending on that of Solution II so that the pAg inside the mixing vessel might be always adjusted to 7.50. On the other hand, after the lapse of 7 minutes from the start of the addition of Solution II, the addition of Solution IV was started, and it was continued for 5 minutes. Subsequent to the conclusion of the addition of Solution II, the formed emulsion was washed and desalted using a sedimentation process, and then dispersed into a water solution containing 100 g of inert gelatin. To the resulting emulsion, sodium thiosulfate and chloroauric acid tetrahydrate were each added in an amount of 34 mg/mole Ag. After the adjustment to pH 8.9 and pAg 7.0 (at 40° C.), the resulting emulsion was kept at 75° C. for 60 minutes to chemical sensitization. Thus, a silver halide emulsion of the kind which formed a latent image predominantly at the surface of the grains was prepared.

A photographic material having the following layer structure was produced by coating compositions prepared so that ingredients cited below might come to have coverages described below, respectively, and named Sample 1.

| Layer Structure | Layer Thickness (μm) |
|---|---|
| i. Protective layer | 1.0 |
| ii. Emulsion layer | 2.0 |
| iii. Dye layer (Antihalation layer) | 1.8 |
| iv. Support | 100 |
| v. Conductive layer | 0.2 |
| vi. Gel layer | 1.4 |

As for the composition of the foregoing constituent layers, excluding the antihalation layer, ingredients and their respective coverages are described below:

| | |
|---|---|
| <Protective Layer> | |
| Inert gelatin | 1300 mg/m$^2$ |
| Colloidal silica | 249 mg/m$^2$ |
| Liquid paraffin | 60 mg/m$^2$ |
| Barium strontium sulfate (average grain size: 1.5 μm) | 32 mg/m$^2$ |
| Proxel | 4.3 mg/m$^2$ |
| Potassium salt of N-perfluoro-octanesulfonyl-N-propylglycine | 5.0 mg/m$^2$ |
| 1,3-Bis(vinylsulfonyl)-2-propanol | 56 mg/m$^2$ |
| 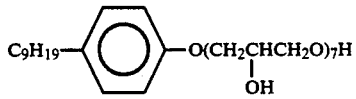 | 15 mg/m$^2$ |
| <Emulsion Layer> | |
| Silver halide emulsion (based on Ag) | 1700 mg/m$^2$ |

-continued

| | |
|---|---|
| Sensitizing dye (Compound a) | 23.8 mg/m$^2$ |
| 5-Methylbenzotriazole | 4.1 mg/m$^2$ |
| Sodium dodecylbenzenesulfonate | 5 mg/m$^2$ |
| 1,3-Bis(vinylsulfonyl)-2-propanol | 56 mg/m$^2$ |
| Sodium polystyrenesulfonate | 35 mg/m$^2$ |
| <Conductive Backing Layer> | |
| $SnO_2$/Sb (ratio: 9/1 by weight, average grain size: 0.25 μm) | 300 mg/m$^2$ |
| Inert gelatin | 170 mg/m$^2$ |
| Proxel | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| <Gel Layer> | |
| Inert gelatin | 1580 mg/m$^2$ |
| Barium strontium sulfate (average grain size: 1.5 μm) | 50 mg/m$^2$ |
| Liquid paraffin | 60 mg/m$^2$ |
| Potassium salt of N-perfluoro-octanesulfonyl-N-propylglycine | 5 mg/m$^2$ |
| Sodium dodecylbenzenesulfonate | 9 mg/m$^2$ |
| Sodium dihexyl-α-sulfosuccinate | 34 mg/m$^2$ |
| Sodium polystyrenesulfonate | 4 mg/m$^2$ |
| Proxel | 5 mg/m$^2$ |

Sensitizing (Compound a):

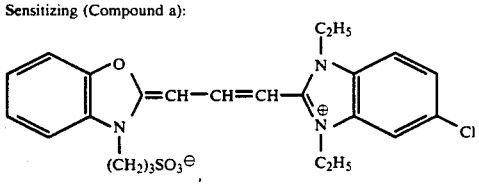

Samples 2 to 7 were produced in the same manner as Sample 1, except that the dye compounds set forth in Table 1 were each incorporated in the dye-fixing layer in place of Compound 2. For the purpose of comparison, Sample 8 was further produced in the same manner as Sample 1, except that neither Compound 2 nor any other dye compound was incorporated in the dye-fixing layer.

The thus prepared samples were each subjected to the photographic processing described below and evaluated with regard to sharpness and color stain.

1) Reversal Development Processing

Reversal development was performed using a deep tank auto processor for reversal process, F-10R, made by U.S. Allen Products, and commercially available processing solutions for reversal process, FR-531, 532, 533, 534 and 535, produced by U.S. FR Chemicals, under the conditions described below.

| Step | Processing Solution | Temperature | Time |
|---|---|---|---|
| 1. First development | FR-531 (1:3) | 43° C. | 15 sec |
| 2. Washing | running water | " | " |
| 3. Bleach | FR-532 (1:3) | " | " |
| 4. Rinsing | FR-533 (1:3) | " | " |
| 5. Exposure | — | — | — |
| 6. Second development | FR-534 (1:3) | 43° C. | 15 sec |
| 7. Fixation | FR-535 (1:3) | " | " |
| 8. Washing | spray | " | " |
| 9. Drying | hot air | — | — |

2) Negative Development Processing

Negative development was performed using a deep tank auto processor, F-10, made by U.S. Allen Products, and a commercially available universal processing solution for microfilms, FR-537 developer, produced by U.S. FR Chemicals, under the conditions described below.

| Step | Processing Solution | Temperature | Time |
|---|---|---|---|
| 1. Development | FR-537 (1:3) | 43° C. | 15 sec |
| 2. Washing | running water | " | " |
| 3. Fixation | FR-535 (1:3) | " | " |
| 4. Washing | spray | " | " |
| 5. Drying | hot air | — | — |

Evaluation of the processed samples' properties was made as follows.

(1) Evaluation of Sharpness

Sharpness was evaluated using MTF. Specifically, the photographic materials were each exposed to white light for 1/100 sec. through a wedge for MTF measurement and then underwent the above-described processing with an auto processor.

MTF was measured with an aperture of 400×2 μm$^2$, and sharpness was evaluated by the MTF value corresponding to a spatial frequency of 20 cycles/mm in the area of an optical density of 1.0.

The results obtained are shown in Table 1.

(2) Evaluation of Color Stain

Unexposed films were subjected to the photographic processing using the above-described auto processor, and then green and blue transmission densities were measured through a Macbeth Status A filter.

The results obtained are shown in Table 1.

TABLE 1

| Sample No. | Dye (coverage: mg/m$^2$) | | Reversal Development MTF | Reversal Development Green Transmission Density after Processing | Reversal Development Blue Transmission Density after Processing | Negative Development MTF | Negative Development Green Transmission Density after Processing | Negative Development Blue Transmission Density after Processing |
|---|---|---|---|---|---|---|---|---|
| 1 | Compound 2 | (140) | 0.92 | 0.03 | 0.03 | 0.91 | 0.04 | 0.04 |
| 2 | Compound 6 | (140) | 0.95 | 0.03 | 0.03 | 0.92 | 0.04 | 0.04 |
| 3 | Compound 14 | (140) | 0.97 | 0.04 | 0.04 | 0.98 | 0.05 | 0.05 |
| 4 | Compound 2 | (140) | 1.03 | 0.05 | 0.03 | 1.03 | 0.05 | 0.04 |
| | Compound (ii) | (140) | | | | | | |
| 5 | Compound 6 | (140) | 1.05 | 0.03 | 0.04 | 1.04 | 0.04 | 0.05 |
| | Compound (ii) | (140) | | | | | | |
| 6 | Compound 29 | (140) | 1.05 | 0.06 | 0.04 | 1.05 | 0.05 | 0.04 |
| | Compound (ii) | (140) | | | | | | |
| 7* | Compound (i) | (140) | 1.04 | 0.06 | 0.06 | 1.04 | 0.07 | 0.06 |
| | Compound (ii) | (140) | | | | | | |
| 8** | absent | | 0.81 | 0.03 | 0.03 | 0.79 | 0.04 | 0.04 |

7*, 8**: Samples for comparison.

The comparative dyes used in combination in Sample No. 7* are the compounds disclosed in WO 88/04794 and are represented by the following structural formulae:

Compound (i)

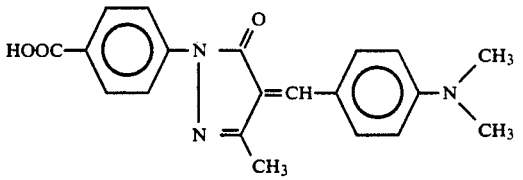

Compound (ii)

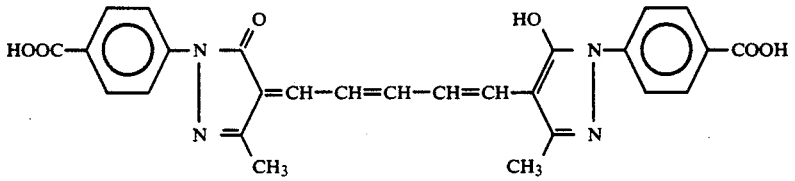

As can be seen from Table 1, Samples 1 to 6 in which the dyes of this invention were incorporated respectively were high in sharpness, compared with Sample 8 to which any dye was not added, and their respective color stain after processing was on the same low level with that of Sample 8. In particular, the combined use of one of the present dyes and Compound (ii) was able to confer higher sharpness on photographic materials, compared with the independent use of any present dye. In contrast, Sample 7 in which a known combination of dyes was incorporated had much color stain after processing, though it was excellent in sharpness. Additionally, it can be said that the color stain after processing is practically no problem so long as it is below 0.05, expressed in terms of transmission density.

EXAMPLE 2

On a cellulose triacetate film support provided in advance with a subbing layer, the following compositions were coated in layers to produce a multilayer color photographic material named Sample 101).

(Composition of Each Constituent Layer)

A figure corresponding to each ingredient represents a coverage expressed in g/m$^2$. As for the silver halides, their corresponding figures are coverages based on silver. As for the sensitizing dyes, on the other hand, such figures are coverages expressed in moles per mole of Ag in the same layer.

| <Sample 101> | |
|---|---|
| First layer (Antihalation layer): | |
| Black colloidal silver | as silver 0.18 |
| Gelatin | 1.40 |
| Second layer (Interlayer): | |
| 2,5-Di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (First red-sensitive emulsion layer): | |
| Emulsion A | as silver 0.25 |
| Emulsion B | as silver 0.25 |
| Sensitizing dye 1a | $6.0 \times 10^{-5}$ |
| Sensitizing dye 2a | $1.8 \times 10^{-5}$ |

-continued

| <Sample 101> | |
|---|---|
| Sensitizing dye 3a | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth layer (Second red-sensitive emulsion layer): | |
| Emulsion G | as silver 1.00 |
| Sensitizing dye 1a | $5.1 \times 10^{-5}$ |
| Sensitizing dye 2a | $1.4 \times 10^{-5}$ |
| Sensitizing dye 3a | $2.3 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Fifth layer (Third red-sensitive emulsion layer): | |
| Emulsion D | as silver 1.60 |
| Sensitizing dye 1a | $5.4 \times 10^{-5}$ |
| Sensitizing dye 2a | $1.4 \times 10^{-5}$ |
| Sensitizing dye 3a | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (Interlayer): | |
| EX-5 | 0.040 |
| HBS-1 | 0.020 |
| Gelatin | 0.80 |
| Seventh layer (First green-sensitive emulsion layer): | |
| Emulsion A | as silver 0.15 |
| Emulsion B | as silver 0.15 |
| Sensitizing dye 4a | $3.0 \times 10^{-5}$ |
| Sensitizing dye 5a | $1.0 \times 10^{-4}$ |
| Sensitizing dye 6a | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth layer (Second green-sensitive emulsion layer): | |
| Emulsion C | as silver 0.45 |
| Sensitizing dye 4a | $2.1 \times 10^{-5}$ |
| Sensitizing dye 5a | $7.0 \times 10^{-5}$ |
| Sensitizing dye 6a | $2.6 \times 10^{-4}$ |

-continued

| <Sample 101> | |
|---|---|
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth layer (Third green-sensitive emulsion layer): | |
| Emulsion E | as silver 1.20 |
| Sensitizing dye 4a | $3.5 \times 10^{-5}$ |
| Sensitizing dye 5a | $8.0 \times 10^{-5}$ |
| Sensitizing dye 6a | $3.0 \times 10^{-4}$ |
| EX-1 | 0.013 |
| EX-11 | 0.065 |
| EX-13 | 0.019 |
| HBS-1 | 0.25 |
| HBS-2 | 0.10 |
| Gelatin | 1.54 |
| Tenth layer (Yellow filter layer): | |
| Yellow colloidal silver | as silver 0.065 |
| EX-5 | 0.080 |
| HBS-1 | 0.030 |
| Gelatin | 0.95 |
| Eleventh layer (First blue-sensitive emulsion layer): | |
| Emulsion A | as silver 0.080 |
| Emulsion B | as silver 0.070 |
| Emulsion F | as silver 0.070 |
| Sensitizing dye 7a | $3.5 \times 10^{-4}$ |
| EX-8 | 0.042 |
| EX-9 | 0.72 |
| HBS-1 | 0.28 |
| Gelatin | 1.10 |
| Twelfth layer (Second blue-sensitive emulsion layer): | |
| Emulsion G | as silver 0.45 |
| Sensitizing dye 7a | $2.1 \times 10^{-4}$ |

-continued

| <Sample 101> | |
|---|---|
| EX-9 | 0.15 |
| EX-10 | $7.0 \times 10^{-3}$ |
| HBS-1 | 0.050 |
| Gelatin | 0.78 |
| Thirteenth layer (Third blue-sensitive emulsion layer): | |
| Emulsion H | as silver 0.77 |
| Sensitizing dye 7a | $2.2 \times 10^{-4}$ |
| EX-9 | 0.20 |
| HBS-1 | 0.070 |
| Gelatin | 0.69 |
| Fourteenth layer (First protective layer): | |
| Emulsion I | as silver 0.20 |
| U-4 | 0.11 |
| U-5 | 0.17 |
| HBS-1 | $5.0 \times 10^{-2}$ |
| Gelatin | 1.00 |
| Fifteenth layer (Second protective layer): | |
| H-1 | 0.40 |
| B-1 (Diameter: 1.7 μm) | $5.0 \times 10^{-2}$ |
| B-2 (Diameter: 1.7 μm) | 0.10 |
| B-3 | 0.10 |
| S-1 | 0.20 |
| Gelatin | 1.20 |

In every constituent layer, W-1, W-2, W-3, B-4, B-5, F-1, F-2, F-3, F-4, F-5, F-6, F-7, F-8, F-9, F-10, F-11, F-12, F-13, an iron salt, a lead salt, a gold salt, a platinum salt, an iridium salt and a rhodium salt were included to improve on keeping quality, processability, pressure resistance, mold and bacteria proofing property, antistatic property and coating facility.

The ingredients used in the foregoing constituent layers are illustrated below:

EX-1

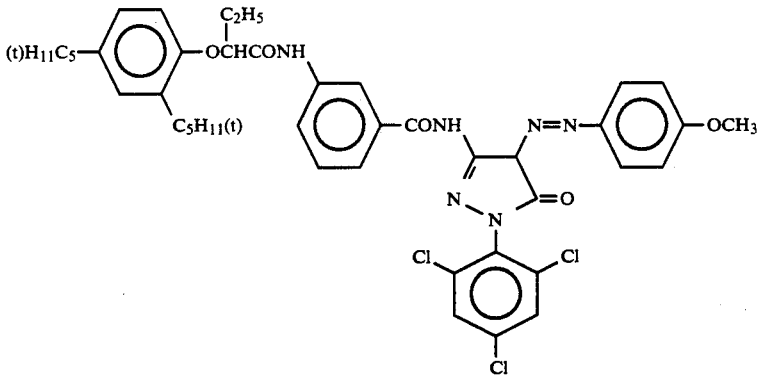

EX-2

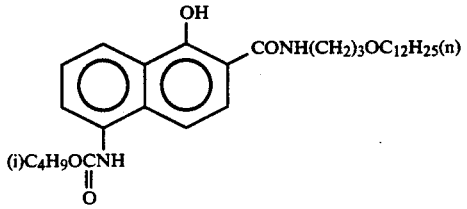

EX-3

-continued
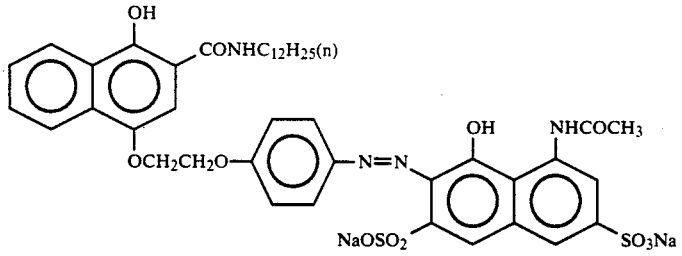
EX-4
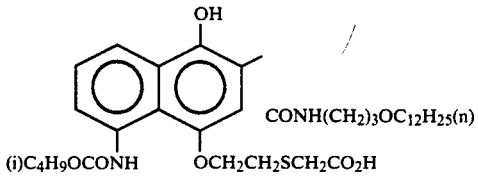
EX-5
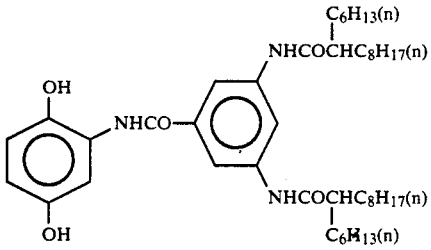
EX-6
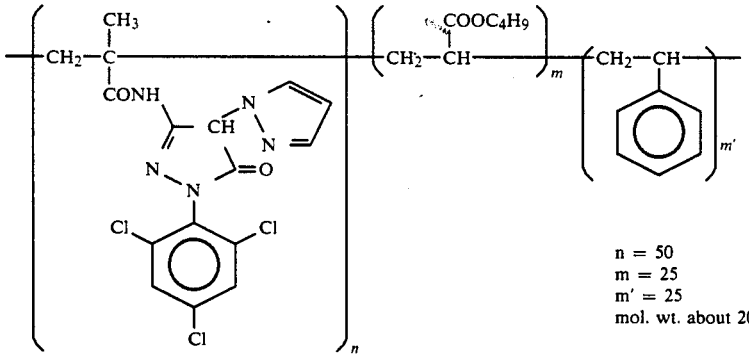
n = 50
m = 25
m' = 25
mol. wt. about 20,000
EX-7
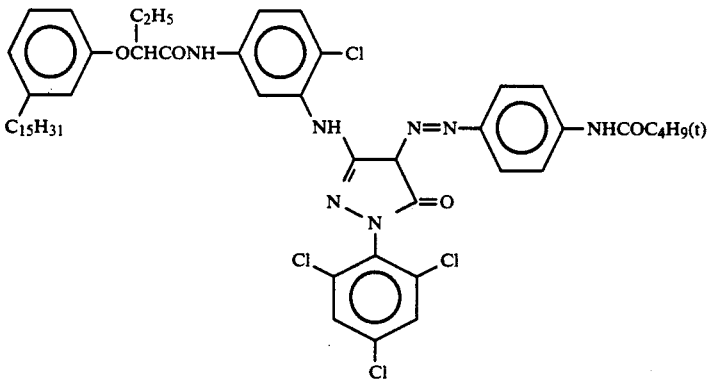
EX-8

-continued
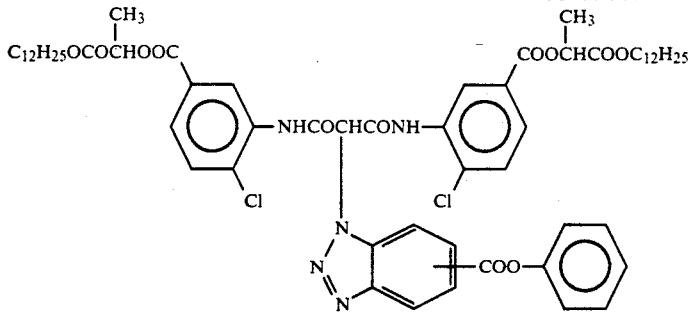
EX-9
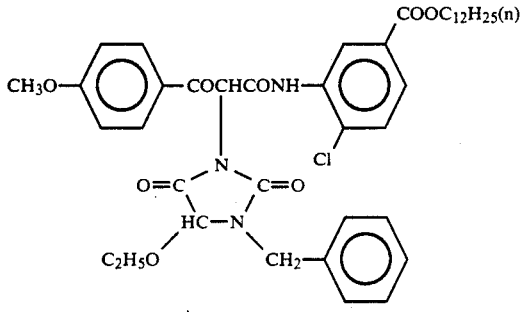
EX-10
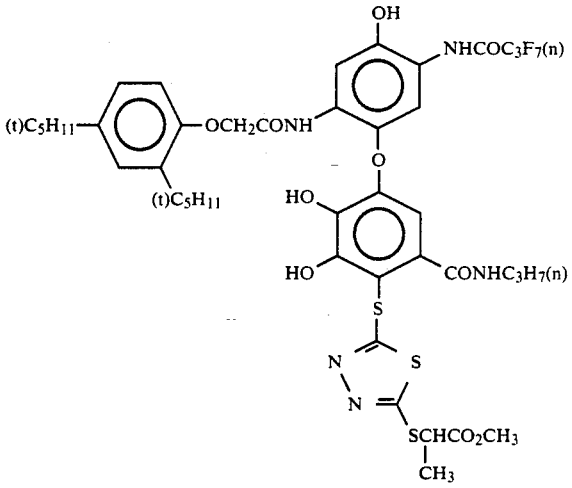
EX-11
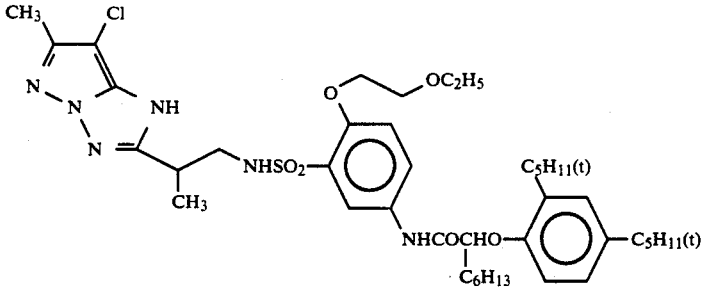
EX-12
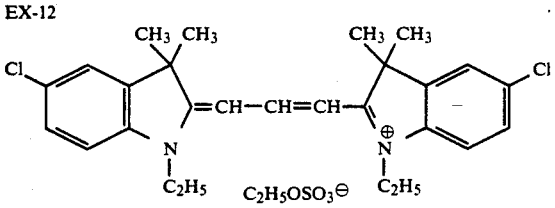

-continued
EX-13
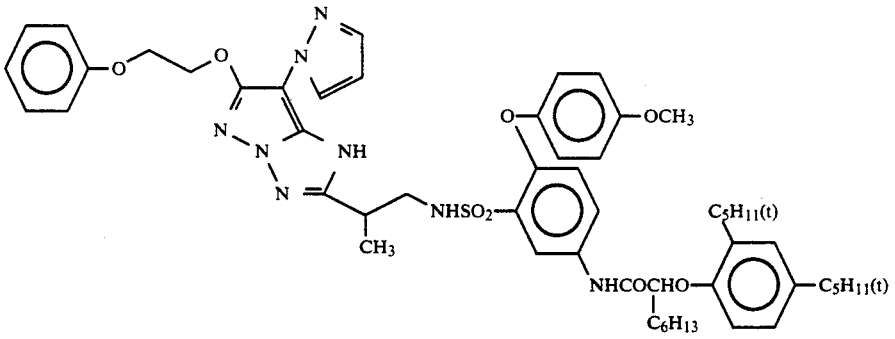
EX-14
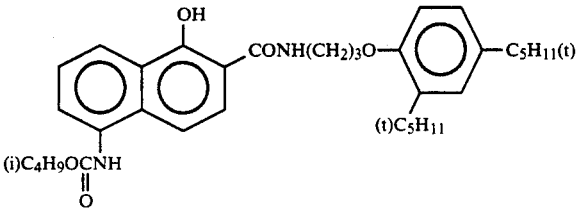
EX-15
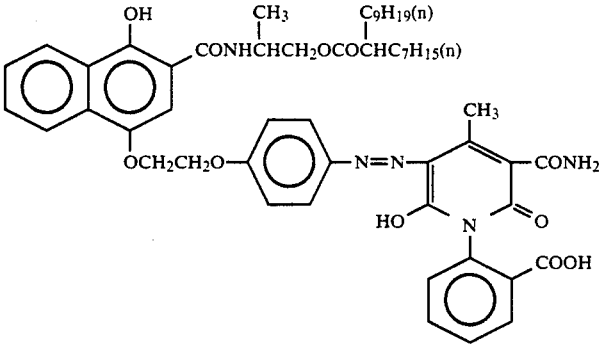
U-1
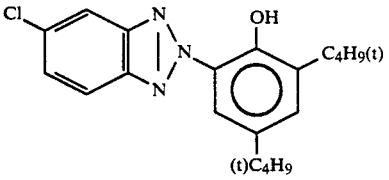
U-2
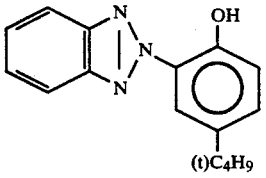
U-3
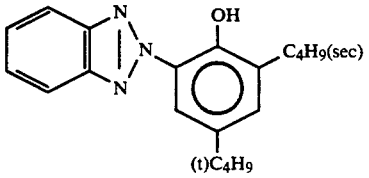
U-4

-continued
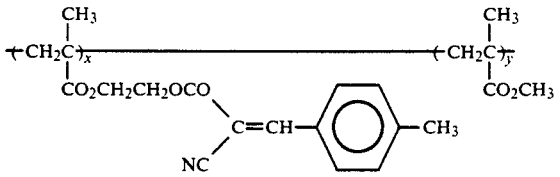
x:y = 70:30 (wt %)
U-5
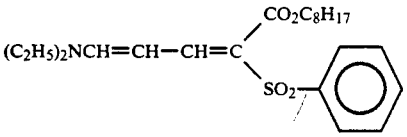
HBS-1
Tricresyl phosphate
HBS-2
Di-n-butylphthalate
HBS-3
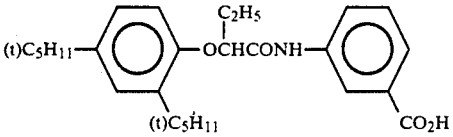
Sensitizing Dye 1a
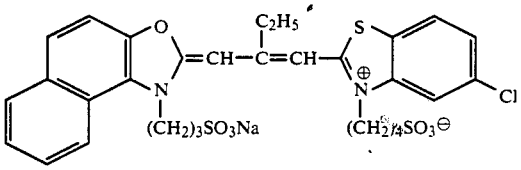
Sensitizing Dye 2a
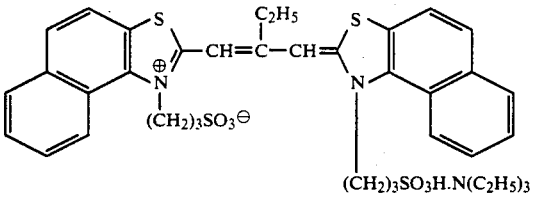
Sensitizing Dye 3a
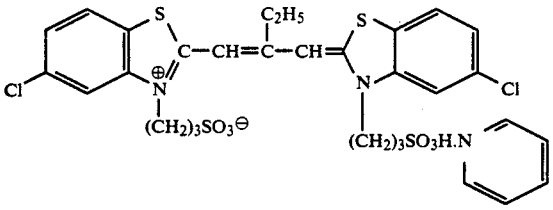
Sensitizing Dye 4a
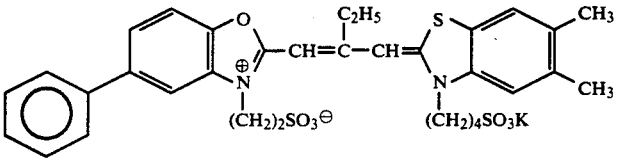
Sensitizing Dye 5a -continued
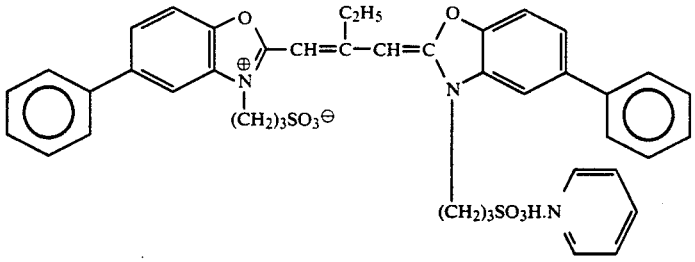
Sensitizing Dye 6a
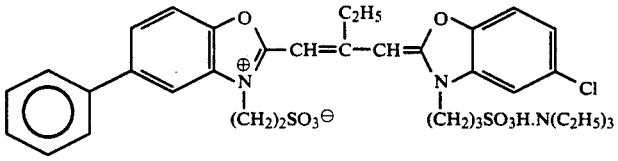
Sensitizing Dye 7a
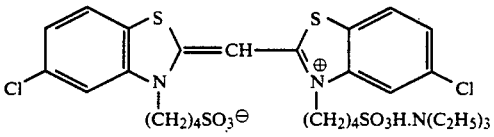
S-1
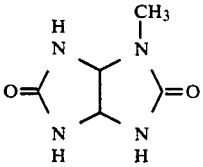
H-1
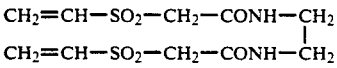
B-1
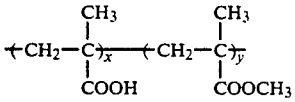
x/y = 10/90
B-2
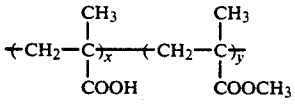
x/y = 40/60
B-3
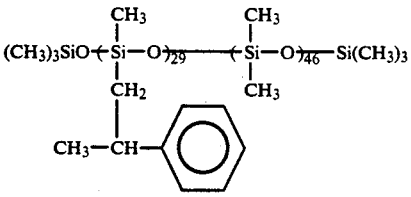
B-4
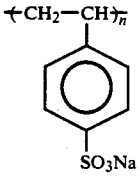

-continued
B-5
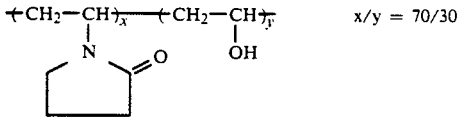
x/y = 70/30
W-1
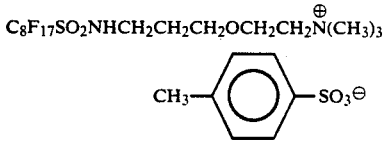
W-2
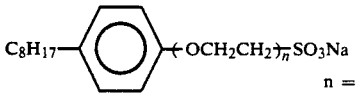
n = 2~4
W-3
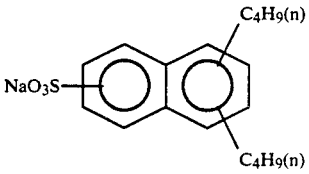
F-1
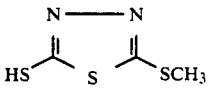
F-2
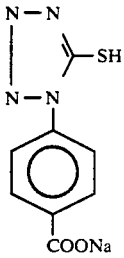
F-3
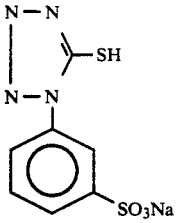
F-4
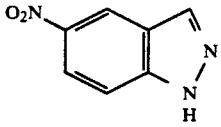
F-5
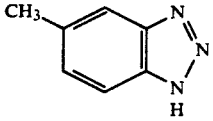

-continued

F-6

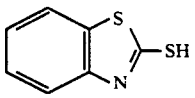

F-7

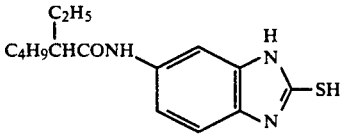

F-8

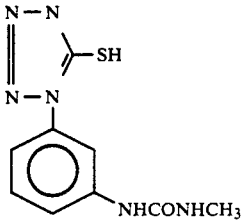

F-9

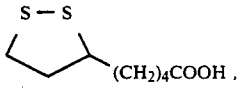

F-10

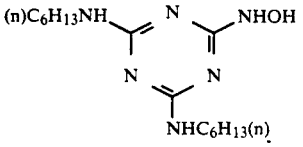

F-11

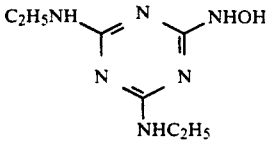

F-12

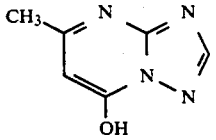

F-13

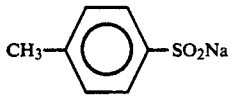

| | Average AgI Content (%) | Average Grain Size (μm) | Variation Coefficient (%) Concerning Grain Size | Ratio of Diameter to Thickness | Silver Content Ratio [AgI content (%)] |
|---|---|---|---|---|---|
| Emulsion A | 4.0 | 0.45 | 27 | 1 | Core/Shell = 1/3 [13/1], dual-structure grains |
| Emulsion B | 8.9 | 0.70 | 14 | 1 | Core/Shell = 3/7 [25/2], dual-structure grains |
| Emulsion C | 10 | 0.75 | 30 | 2 | Core/Shell = 1/2 [24/3], dual-structure grains |
| Emulsion D | 16 | 1.05 | 35 | 2 | Core/Shell = 4/6 [40/0], dual-structure grains |

-continued

| | Average AgI Content (%) | Average Grain Size (μm) | Variation Coefficient (%) Concerning Grain Size | Ratio of Diameter to Thickness | Silver Content Ratio [AgI content (%)] |
|---|---|---|---|---|---|
| Emulsion E | 10 | 1.05 | 35 | 3 | Core/Shell = 1/2 [24/3], dual-structure grains |
| Emulsion F | 4.0 | 0.25 | 28 | 1 | Core/Shell = 1/3 [13/1], dual-structure grains |
| Emulsion G | 14.0 | 0.75 | 25 | 2 | Core/Shell = 1/2 [42/0], dual-structure grains |
| Emulsion H | 14.5 | 1.30 | 25 | 3 | Core/Shell = 37/63 [34/3], dual-structure grains |
| Emulsion I | 1 | 0.07 | 15 | 1 | uniform grains |

Multilayer photographic materials were produced in the same manner as Sample 101, except that instead of using yellow colloidal silver in the tenth layer, dispersions of Compounds 5, 11 and 27 exemplifying the dyes of this invention and those of the comparative compounds, Cpd 94 and Cpd 95, were used respectively. Therein, each dispersion was prepared by dissolving each dye compound in a mixture of tricresyl phosphate and ethyl acetate, wherein the ratio of tricresyl phosphate to the dye compound was controlled to 2, and then emulsifying the resulting solution together with gelatin. The prepared dispersion was coated at a coverage of $4\times10^{-4}$ mole/m$^2$, based on the dye compound. The thus produced materials were named Sample 102, Sample 103, Sample 104, Sample 105 and Sample 106, respectively.

In addition, Sample 107 was prepared in the same manner as Sample 101, except that yellow colloidal silver was not incorporated in the tenth layer.

The dye compounds used for comparison are illustrated below:

Cpd 94

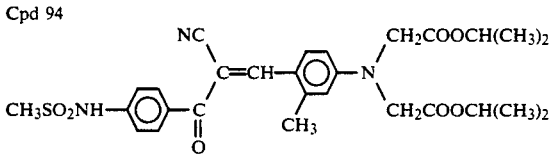

Cpd 95

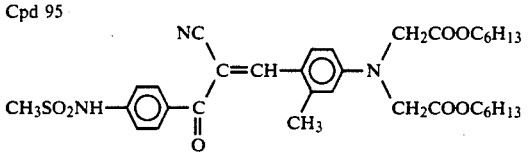

Each of Samples 101 to 107 were exposed wedgewise and then subjected to the photographic processing described below.

On the other hand, each dye compound was examined for the extent of decolorization by preparing a processing solution by removing 4-(N-ethyl-N-β-hydroxyethylamino)-2-methylaniline sulfate from the color developer used in the color development step described below, and using this processing solution in the development step, followed by the subsequent processing steps.

A difference in yellow density between each of Samples 101 to 106 and Sample 107 is denoted as ΔDmin.

<Photographic Processing>

| Step | Processing Time | Processing Temperature |
|---|---|---|
| Color development | 3 min. 15 sec. | 38° C. |

-continued

<Photographic Processing>

| Step | Processing Time | Processing Temperature |
|---|---|---|
| Bleach | 6 min. 30 sec. | 38° C. |
| Washing | 2 min. 10 sec. | 24° C. |
| Fixation | 4 min. 20 sec. | 38° C. |
| Washing (1) | 1 min. 05 sec. | 24° C. |
| Washing (2) | 1 min. 00 sec. | 24° C. |
| Stabilization | 1 min. 05 sec. | 38° C. |
| Drying | 4 min. 20 sec. | 55° C. |

Compositions of processing solutions used are described below.

| | |
|---|---|
| Color developer: | |
| Diethylenetriaminepenta-acetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-Ethyl-N-β-hydroxyethylamino]-2-methylaniline sulfate | 4.5 g |
| Water to make | 1.0 l |
| pH adjusted to | 10.05 |
| Bleaching Solution: | |
| Sodium ethylenediaminetetra-acetatoferrate(III) trihydrate | 100.0 g |
| Disodium ethylenediamine-tetraacetate | 10.0 g |
| Ammonium bromide | 140.0 g |
| Ammonium nitrate | 30.0 g |
| Aqueous ammonia (27%) | 6.5 ml |
| Water to make | 1.0 l |
| pH adjusted to | 6.0 |
| Fixing Solution: | |
| Disodium ethylenediamine-tetraacetate | 0.5 g |
| Sodium sulfite | 7.0 g |
| Sodium hydrogen sulfite | 5.0 g |
| Aqueous solution of ammonium thiosulfate (70%) | 170.0 ml |
| Water to make | 1.0 l |
| pH adjusted to | 6.7 |
| Stabilizing Solution: | |
| Formaldehyde (37%) | 2.0 ml |
| Polyoxyethylene-p-monononylphenyl ether (mean polymerization degree: 10) | 0.3 g |
| Disodium ethylenediamine-tetraacetate | 0.05 g |
| Water to make | 1.0 l |
| pH adjusted to | 5.0–8.0 |

The results obtained are shown in Table 2.

TABLE 2

| Sample No. | Tenth Layer | ΔDmin | Green-sensitive Emulsion Layer Relative Sensitivity | Green-sensitive Emulsion Layer Fog |
|---|---|---|---|---|
| 101 (Comparison) | Yellow Colloidal Ag | 0 | 100 | 0.08 |
| 102 (Invention) | Compound 5 | 0.02 | 109 | 0.03 |
| 103 (Invention) | Compound 11 | 0.01 | 112 | 0.04 |
| 104 (Invention) | Compound 27 | 0.02 | 105 | 0.03 |
| 105 (Comparison) | Cpd 94 | 0.05 | 110 | 0.05 |
| 106 (Comparison) | Cpd 95 | 0.29 | 110 | 0.04 |

As can be seen from Table 2, the present samples 102, 103 and 104 were high in sensitivity of their green-sensitive emulsion layer and low in fog. In addition, the samples produced in accordance with the present invention have proved to be excellent in extent of decolorization.

In contrast, the sample using yellow colloidal silver was high in fog with respect to its green-sensitive emulsion layer, and the comparative samples 105 and 106 were also high in fog. In addition, the comparative sample 106 was significantly inferior in extent of decolorization.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one compound represented by the following general formula (I):

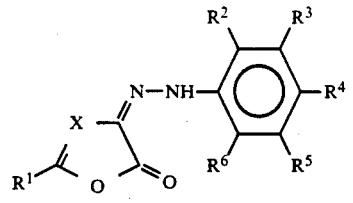

(I)

wherein X represents a nitrogen atom or a methine group; $R^1$ represents a hydrogen atom, an alkyl group, an aryl group, or a heterocyclyl group; $R^2$, $R^3$, $R^4$, $R^5$ and $R^6$ each represents a hydrogen atom, a halogen atom, an alkyl group, an aryl group, $—OR^7$, $—COOR^7$, $—COR^7$, $—CONR^7R^8$, $—SO_2NR^7R^8$, $—NR^7R^8$, $—SO_2NHCOR^7$, $—SO_2NHSO_2R^7$, $—CONHCOR^7$, $—CONHSO_2R^7$, $—N(R^7)SO_2R^8$, or $—N(R^7)COR^8$; and $R^7$ and $R^8$ each represents a hydrogen atom, an alkyl group, an aryl group, or a heterocyclyl group.

2. The silver halide photographic material as claimed in claim 1, wherein said compound represented by general formula (I) is contained in the form of a dispersion of solid fine particles.

3. The silver halide photographic material as claimed in claim 1, which has a hydrophilic colloid layer containing said compound represented by general formula (I) in the form of oil composition and/or polymer latex composition.

4. The silver halide photographic material as claimed in claim 3, wherein said hydrophilic colloid layer is a yellow filter layer.

5. The silver halide photographic material as claimed in claim 1, wherein X represents a methine group.

6. The silver halide photographic material as claimed in claim 1, wherein X represents a nitrogen atom.

* * * * *